US006223010B1

(12) United States Patent
Araki

(10) Patent No.: US 6,223,010 B1
(45) Date of Patent: Apr. 24, 2001

(54) RESIN PRODUCT, METHOD OF DISASSEMBLING THE RESIN PRODUCT, PROCESS CARTRIDGE, METHOD OF DISASSEMBLING THE PROCESS CARTRIDGE, AND ELECTROPHOTOGRAPHIC IMAGE FORMING APPARATUS

(75) Inventor: Ryuji Araki, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/480,176

(22) Filed: Jan. 10, 2000

(30) Foreign Application Priority Data

Jan. 12, 1999 (JP) ..... 11-005099
Dec. 22, 1999 (JP) ..... 11-364162

(51) Int. Cl.[7] ..... G03G 21/00; G03G 15/00

(52) U.S. Cl. ..... 399/109; 399/111; 399/113; 219/121.67

(58) Field of Search ..... 399/109, 111, 399/113, 411; 219/121.6, 121.67, 121.69

(56) References Cited

U.S. PATENT DOCUMENTS 5,781,831 * 7/1998 Matsuzaki et al. ..... 399/119
5,825,472 10/1998 Araki et al. ..... 355/200
5,960,238 * 9/1999 Ohgami ..... 399/258
6,029,031 * 2/2000 Yokomori et al. ..... 399/109

FOREIGN PATENT DOCUMENTS 7-92885 * 4/1995 (JP) .
9-62167 * 3/1997 (JP) .

* cited by examiner

*Primary Examiner*—Richard Moses
(74) *Attorney, Agent, or Firm*—Fitzpatrick, Cella, Harper & Scinto

(57) ABSTRACT

A resin product has at least two resin molded parts and a recyclable part as constituent parts. The resin product is provided with a material layer easy to cut by a laser and a material layer difficult to cut by the layer, the material layer difficult to cut by the laser being disposed so that the recyclable part may not be cut by the use of the laser, the material layer easy to cut by the laser being constructed so as to be capable of being cut by the laser.

55 Claims, 9 Drawing Sheets

RESIN PRODUCT, METHOD OF DISASSEMBLING THE RESIN PRODUCT, PROCESS CARTRIDGE, METHOD OF DISASSEMBLING THE PROCESS CARTRIDGE, AND ELECTROPHOTOGRAPHIC IMAGE FORMING APPARATUS

BACKGROUND OF THE INVENTION

1. Field of the Invention

This invention relates to a resin product, a method of disassembling the resin product, a process cartridge, a method of disassembling the process cartridge, and an electrophotographic image forming apparatus.

The electrophotographic image forming apparatus is an apparatus forming an image on a recording medium by the use of the electrophotographic image forming method, and the term "electrophotographic image forming apparatus" covers, for example, an electrophotographic copier, an electrophotographic printer (such as a laser printer or an LED printer), a facsimile apparatus and a word processor.

Also, the term "process cartridge" refers to charging means, developing means or cleaning means and an electrophotographic photosensitive member integrally made into a cartridge detachably mountable to the main body of the electrophotographic image forming apparatus. The process cartridge also refers to at least one of charging means, developing means and cleaning means and an electrophotographic photosensitive member integrally made into a cartridge detachably mountable to the main body of the electrophotographic image forming apparatus. The process cartridge further refers to at least developing means and an electrophotographic photosensitive member integrally made into a cartridge detachably mountable to the main body of the electrophotographic image forming apparatus.

2. Related Background Art

In an electrophotographic image forming apparatus using the electrophotographic image forming process, there has heretofore been adopted a process cartridge system in which an electrophotographic photosensitive member and process means acting on the electrophotographic photosensitive member are integrally made into a cartridge detachably mountable to the main body of the image forming apparatus. According to this process cartridge system, the maintenance of the apparatus can be done not by a serviceman but by a user himself and therefore, the operability of the apparatus could be markedly improved. So, this process cartridge system is widely used in image forming apparatuses.

Such a process cartridge loses its commodity value as a process cartridge when the developer in it is consumed. Such cartridges, which have lost their commodity value as process cartridges, are collected from the market, and recyclable parts are taken out of those cartridges. It has been conceived to inspect those taken-out parts, and thereafter recycle the parts judged to be recyclable.

For example, in a process cartridge, a cartridge frame as an outer packaging part is constructed of two or more resin molded parts. The cartridge frame contains therein an electrophotographic photosensitive member, a charging roller as the charging member of charging means, a development sleeve as the developing member of developing means, a cleaning blade as the cleaning member of cleaning means, etc. Such constituent parts, as the charging roller, the development sleeve and a cleaning blade supporting member for supporting the cleaning blade provided in the process cartridge as a resin product of such construction, have long lives and may be usable still after a developer (hereinafter referred to as the toner) in the process cartridge has been consumed.

Therefore, recently, the process cartridge after the toner therein has been consumed is collected and the cartridge frame thereof is disassembled, whereby recyclable constituent parts are taken out of the cartridge frame for recycling.

SUMMARY OF THE INVENTION

The present invention is a further development of the above-described prior art. It is an object of the present invention to provide a resin product what parts to be recycled can be taken out easily without being damaged.

It is an object of the present invention to provide a method of disassembling a resin product whose parts to be recycled can be taken out easily without being damaged.

It is an object of the present invention to provide a process cartridge from which parts to be recycled can be taken out easily without being damaged. it is an object of the present invention to provide a method of disassembling a process cartridge what parts to be recycled can be taken out easily without being damaged.

It is an object of the present invention to provide a method of disassembling a process cartridge whose charging means to be recycled can be taken out easily without being damaged.

It is an object of the present invention to provide a process cartridge whose charging-means parts to be recycled can be taken out easily without being damaged.

It is an object of the present invention to provide an electrophotographic image forming apparatus which a process cartridge from whose charging-means parts to be recycled can be taken out easily without being damaged is detachably mountable.

It is another object of the present invention to provide a resin product having at least two resin molded parts and a recyclable part as constituent parts, the resin product being provided with a material layer that is easy to cut by a laser and a material layer that is difficult to cut by the laser, the material layer that is difficult to cut by the laser being disposed so that the recyclable part may not be cut by the use of the laser, the material layer that is easy to cut by the laser being constructed so as to be capable of being cut by the laser.

It is another object of the present invention to provide a method of disassembling a resin product having at least two resin molded parts and a recyclable part as constituent parts, the method being provided with a cutting step of cutting the resin product into at least several divisions, a disassembling step of disassembling the resin product cut into the several divisions by the cutting step to constituent part units, and a sorting step of sorting the constituent parts of the resin product disassembled by the disassembling step by the uses of recycle, wherein the resin product is provided with a material layer that is easy to cut by a laser and a material layer that is difficult to cut by the laser, whereby in the cutting at the cutting step, the material layer that is easy to cut by the laser is cut by the use of the laser.

It is another object of the present invention to provide a process cartridge detachably mountable to the main body of an electrophotographic image forming apparatus, the process cartridge comprising an electrophotographic photosensitive member, process means acting on the electrophotographic photosensitive member, and a cartridge frame for supporting the electrophotographic photosensitive member and the process means, the cartridge having at least two resin molded parts and a recyclable part, and being provided with a material layer that is easy to cut by a laser and a material layer that is difficult to cut by the laser, the material layer that is difficult to cut by the layer being disposed so that the recyclable part may not be cut by the use of the laser, the material layer that is easy to cut by laser being constructed so as to be capable of being cut by the use of the laser.

It is another object of the present invention to provide a method of disassembling a process cartridge detachably mountable to a main body of an electrophotographic image forming apparatus. The method is provided with a cutting step of cutting a cartridge supporting an electrophotographic photosensitive member and process means acting on the electrophotographic photosensitive member, and having at least two resin molded parts and a recyclable part as constituent parts cut into at least several divisions, a disassembling step of disassembling the cartridge cut into the several divisions by the cutting step to constituent part units, and a sorting step of sorting the constituent parts of the cartridge disassembled by the disassembling step by the uses of recycling, wherein the cartridge is provided with a material layer that is easy to cut by a laser and a material layer that is difficult to cut by the laser, whereby in the cutting at the cutting step, the material layer that is easy to cut by the laser is cut by the use of the laser.

It is another object of the present invention to provide a method of disassembling a process cartridge detachably mountable to a main body of an electrophotographic image forming apparatus. The method has a cutting step of cutting the process cartridge, having an electrophotographic photosensitive member, charging means for charging the electrophotographic photosensitive member, and a material layer that is difficult to cut by a laser disposed in the charging means, into several divisions by the use of the laser so as to have the disposition area of the material layer that is difficult to cut by the laser, thereby taking out at least one part constituting the charging means.

It is another object of the present invention to provide a process cartridge detachably mountable to a main body of an electrophotographic image forming apparatus, the process cartridge having an electrophotographic photosensitive member, charging means for charging the electrophotographic photosensitive member, a material layer that is difficult to cut by a laser disposed in the charging means, and a cartridge frame holding the electrophotographic photosensitive member and the charging means, and capable of being cut into several divisions by the use of the laser so as to have the disposition area of the material layer that is difficult to cut by the laser, thereby taking out at least one part constituting the charging means.

It is another object of the present invention to provide an electrophotographic image forming apparatus for forming an image on a recording medium to a main body of which a process cartridge is detachably mountable. The apparatus has (a) mounting means for detachably mounting the process cartridge having an electrophotographic photosensitive member, charging means for charging the electrophotographic photosensitive member, a material layer that is difficult to cut by a laser disposed in the charging means, and a cartridge frame holding the electrophotographic photosensitive member and the charging means, and capable of being cut into several divisions by the use of the laser so as to have the disposition area of the material layer that is difficult to cut by the laser, thereby taking out at least one part constituting the charging means, and (b) conveying means for conveying the recording medium.

In the resin product to which the present invention is applied, the material layer of the resin product that is difficult to cut by the laser protects the recyclable part from the cutting by the laser, and the material layer of the resin product that is easy to cut by the laser is cut by the use of the laser.

By this arrangement, the recyclable part of the resin product can be taken out easily without being damaged.

In the method of disassembling a resin product to which the present invention is applied, at the cutting step in the method of disassembling the resin product, the material layer of the resin product that is difficult to cut by the laser protects the recyclable part from the cutting by the laser, and the material layer of the resin product that is easy to cut by the laser is cut by the use of the laser. By this arrangement, the recyclable part of the resin product can be taken out easily without being damaged.

In the process cartridge to which the present invention is applied, the material layer of the cartridge frame that is difficult to cut by the laser protects the recyclable part from the cutting by the laser, and the material layer of the cartridge frame that is easy to cut by the laser is cut by the use of the laser. By this arrangement, the recyclable part of the process cartridge can be taken out easily from the cartridge frame without being damaged.

In the method of disassembling a process cartridge to which the present invention is applied, at the step of cutting the process cartridge, the material layer of the cartridge frame that is difficult to cut by the laser protects the recyclable part from the cutting by the laser, and the material layer of the cartridge frame that is easy to cut by the laser is cut by the use of the laser. By this arrangement, the recyclable part of the process cartridge can be taken out easily from the cartridge frame without being damaged.

In the method of disassembling a process cartridge to which the present invention is applied, when the process cartridge is to be cut by the use of the laser, the material layer that is difficult to cut by the laser protects the charging means from the cutting by the laser. As a result, the recyclable part of the charging means can be taken out easily from the process cartridge without being damaged.

In the process cartridge to which the present invention is applied, when the cartridge frame is to be cut by the use of the laser, the material layer that is difficult to cut by the laser protects the charging means from the cutting by the laser. As a result, the recyclable part of the charging means can be taken out easily from the cartridge frame without being injured.

In the electrophotographic image forming apparatus to which the present invention is applied, the process cartridge can be detachably mounted on the mounting means. When the cartridge frame of this process cartridge is to be cut by the use of the laser, the material layer that is difficult to cut by the laser protects the charging means from the cutting by the laser. Thereby, the recyclable part of the charging means can be taken out easily from the cartridge frame without being damaged.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some embodiments of the present invention will hereinafter be specifically described with reference to the drawings.

First Embodiment

Figure 1:
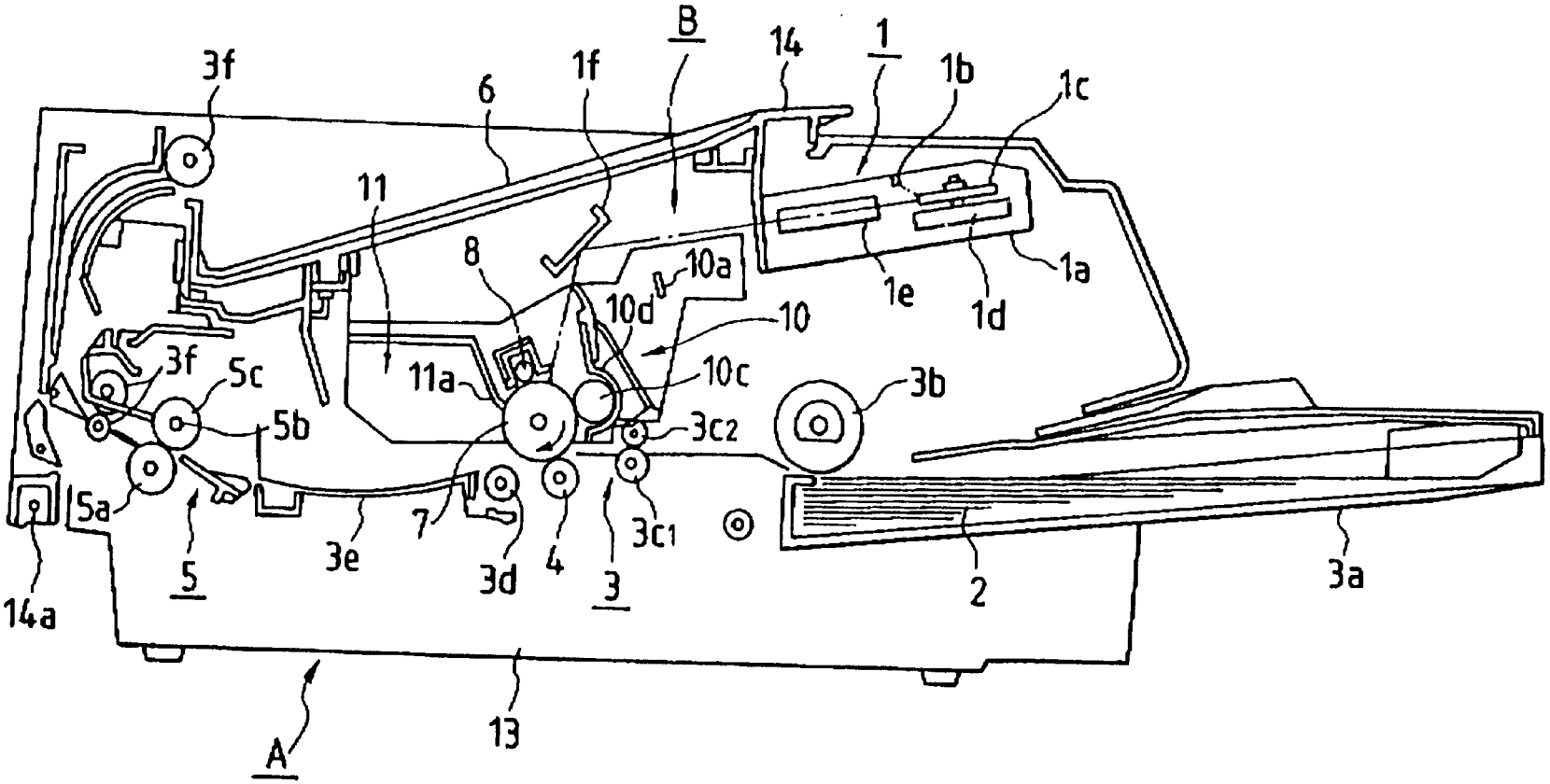
FIG. 1 is a typical illustration showing the construction of an electrophotographic image forming apparatus according to a first embodiment.
Figure 2:
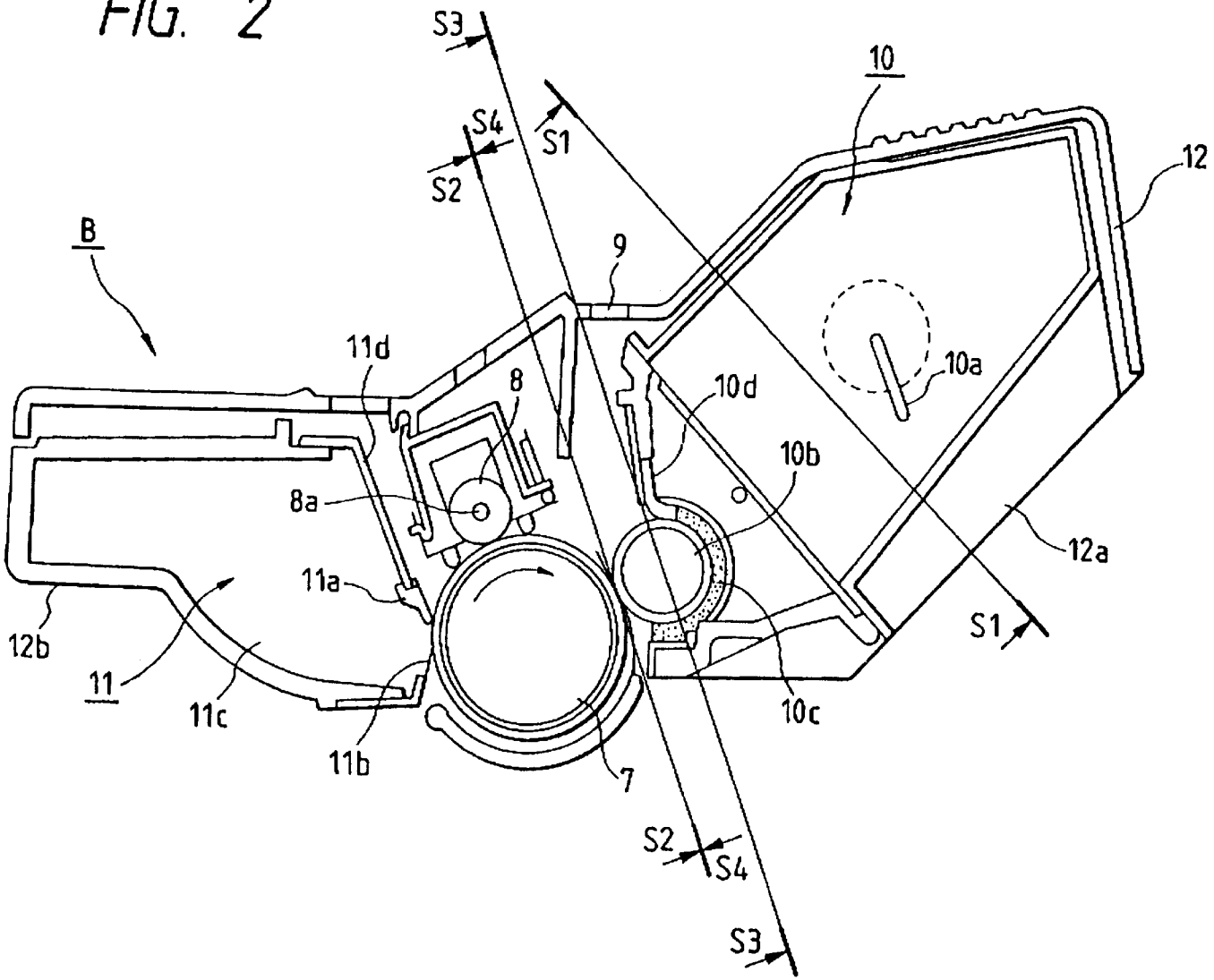
FIG. 2 is a typical illustration showing the construction of a process cartridge according to the first embodiment.

FIG. 1 is a typical illustration showing the construction of an electrophotographic image forming apparatus (laser beam printer) having mounted thereto a process cartridge as a resin product to which an embodiment of the present invention is applied, and FIG. 2 is a typical illustration showing the construction of the process cartridge.

As the order of description, the general construction of the electrophotographic image forming apparatus having the process cartridge mounted thereto will first be described, and then the cutting and disassembly by a laser in case of the recycle of the process cartridge will be described.

{General Construction}

This electrophotographic image forming apparatus (laser beam printer) A, as shown in FIG. 1, applies an optical image based on image information from an optical system 1 and forms a developer (hereinafter referred to as the "toner") image on a drum-shaped electrophotographic photosensitive member (hereinafter referred to as the "photosensitive drum") 7 in the process cartridge B. A recording medium 2 is then conveyed by conveying means 3 in synchronism with the formation of the toner image, and the toner image formed on the photosensitive drum 7 in the process cartridge B is transferred to the recording medium 2 by transfer means 4. The recording medium 2 is then conveyed to fixing means 5, whereby the transferred toner image is fixed and the recording medium 2 is discharged to a discharge portion 6.

On the other hand, in the process cartridge B, as shown in FIG. 2, the photosensitive drum 7 is rotated and the surface thereof is uniformly charged by charging means 8, and the photosensitive drum 7 is exposed to the optical image from the optical system 1 through an exposure portion 9 to thereby form an electrostatic latent image, and a toner image conforming to the latent image is formed by developing means 10 and is thereby visualized. After the toner image is transferred to the recording medium 2 by the transfer means 4, any toner remaining on the photosensitive drum 7 is removed by cleaning means 11. Such parts as the photosensitive drum 7, the charging means 8, the developing means 10 and the cleaning means 11 are contained in a toner frame 12*a* and a cleaning frame 12*b*, which are resin, molded parts made of resin constituting a housing 12 as the cartridge frame of the process cartridge B and are integrally made into a cartridge.

{Electrophotographic Image Forming Apparatus}

The construction of each portion of the electrophotographic image forming apparatus A will now be described in the order of the optical system, the conveying means, the transfer means, the fixing means and cartridge mounting means.

(Optical System)

The optical system 1 serves to apply light on the basis of image information read from an external apparatus or the like to thereby apply an optical image to the photosensitive drum 7. The optical system 1, as shown in FIG. 1, contains a laser diode 1*b*, a polygon mirror 1*c*, a scanner motor 1*d* and an imaging lens 1*e* in an optical unit 1*a*.

When an image signal is given from an external apparatus such as a computer or a word processor, the laser diode 1*b* emits light in conformity with the image signal and applies it as image light to the polygon mirror 1*c*. This polygon mirror 1*c* is rotated at a high speed by the scanner motor 1*d*, and the image light reflected by the polygon mirror 1*c* is applied to the rotating photosensitive drum 7 through the intermediary of the imaging lens 1*e* and a reflecting mirror 1*f*, and the surface of the photosensitive drum 7 is selectively exposed to the image light to thereby form an electrostatic latent image conforming to the image information.

(Recording Medium Conveying Means)

The conveying means 3 for conveying the recording medium (for example, recording paper, an OHP sheet, cloth or a thin sheet) has a mounting portion for a cassette 3*a* on the main body 13 of the apparatus, and supplies recording media 2 in the cassette 3*a* mounted on the mounting portion, one by one, from the uppermost recording medium to a pair of registration rollers 3*c*1 and 3*c*2 by a pickup roller 3*b*. The pair of registration rollers 3*c*1 and 3*c*2 convey the recording medium 2 to the image transfer portion between the photosensitive drum 7 and the transfer means 4 in synchronism with the image forming operation. After the image transfer, the recording medium 2 is conveyed to the fixing means 5 by a conveying roller 3*d* and a guide plate 3*e*, and after the fixing, the recording medium 2 is discharged to the discharge portion 6 formed on the upper portion of the apparatus by a discharge roller 3*f*.

(Transfer Means)

The transfer means 4 serves to transfer the toner Image formed on the photosensitive drum 7 to the recording medium 2. In the present embodiment, as shown in FIG. 1, the transfer means 4 is constituted by a transfer roller 4. That is, the recording medium 2 is urged against the photosensitive drum 7 in the process cartridge B mounted to the main body 13 of the apparatus by the transfer roller 4, and a voltage opposite in polarity to the toner image formed on the photosensitive drum 7 is applied to the transfer roller 4 to thereby transfer the toner image on the photosensitive drum 7 to the recording medium 2.

(Fixing Means)

The fixing means 5 serves to fix the toner image transferred to the recording medium 2 by the application of the voltage to the transfer roller 4. The construction of the fixing means, as shown in FIG. 1, comprises a drivingly rotated drive roller 5*a* and a fixing roller 5*c* having a heater 5*b* therein and urged against and rotatively driven by the drive roller 5*a*. That is, when the recording medium 2 having the toner image on the photosensitive drum 7 transferred thereto passes between the drive roller 5*a* and the fixing roller 5*c*, pressure is applied to the recording medium by the pressing of the two rollers 5*a* and 5*c*, whereby the toner on the recording medium 2 is fixed on the recording medium 2.

(Process Cartridge Mounting Means)

Cartridge mounting means for mounting the process cartridge B is provided in the main body 13 of the apparatus. The mounting and dismounting of the process cartridge B with respect to the main body 13 of the apparatus are effected by opening an openable and closable cover 14. That is, the openable and closable cover 14 openable and closable by a hinge 14*a* is attached to the upper portion of the main body 13 of the apparatus. When the openable and closable cover 14 is opened, there is provided a cartridge mounting space (not shown) in the main body 13 of the apparatus, and guide members, not shown, are attached to the right and left wall surfaces of the main body 13 of the apparatus that define the cartridge mounting space. Guides for mounting the process cartridge B are provided on the guide members, and the process cartridge B may be inserted along the guides and the openable and closable cover 14 may be closed to thereby mount the process cartridge B to the main body 13 of the apparatus.

{Process Cartridge}

A description will now be provided of the construction of each portion of the process cartridge B to be mounted to the main body 13 of the apparatus.

This process cartridge B is provided with the photosensitive drum 7 and at least one process means. As the process means there are, for example, charging means for charging the surface of the photosensitive drum 7, developing means for developing the electrostatic latent image formed on the photosensitive drum 7 by the toner to thereby form a toner image, cleaning means for removing any toner remaining on the surface of the photosensitive drum 7, etc.

The process cartridge B according to the present embodiment, as shown in FIG. 2, comprises charging means 8, an exposure portion 9, developing means 10 and cleaning means 11 disposed around the photosensitive drum 7, and covered with a housing 12 as a cartridge frame comprising a toner frame 12*a* and a cleaning frame 12*b* and made into a unit detachably mountable to the main body 13 of the apparatus.

The construction of each portion of the process cartridge B will now be described in the order of the photosensitive drum 7, the charging means 8, the exposure portion 9, the developing means 10 and the cleaning means 11.

(Photosensitive Drum)

The photosensitive drum 7 in the present embodiment is constructed by applying an organic photoconductive layer to the outer peripheral surface of a drum base comprising cylindrical aluminum. This photosensitive drum 7 is rotatably mounted on the cleaning frame 12*b*, and a flange gear (not shown) is secured to one lengthwise (axial) end of the photosensitive drum 7. The driving force of a driving motor (not shown) provided on the main body 13 side of the apparatus is transmitted to the flange gear (not shown) to thereby rotate the photosensitive drum 7 in the direction indicated by the arrow in FIG. 1 in conformity with the image forming operation.

(Charging Means)

The charging means is for uniformly charging the surface of the photosensitive drum 7. In the present embodiment, use is made of the so-called contact charging method in which the charging roller 8 is rotatably mounted on the cleaning frame 12*b*. The charging roller 8 comprises an electrically conductive elastic layer provided on a metallic charging roller shaft 8*a*, an elastic layer of high resistance provided thereon, and protective film further provided on the surface thereof. The electrically conductive elastic layer is formed of carbon dispersed in an elastic rubber layer of EPDM (ethylene-propylene-diene methylene rubber) or NBR (nitrile-butadiene rubber) or the like, and acts to direct a bias voltage supplied to the charging roller shaft 8*a*. Also, the elastic layer of high resistance is formed of urethane rubber or the like, and as an example thereof, mention may be made of a layer containing a slight amount of electrically conductive powder. Thereby, even when the charging roller 8 of high electrical conductivity is opposed to the pinhole or the like of the photosensitive drum 7, the leak current to the photosensitive drum 7 is limited to thereby prevent the drop of the bias voltage. Also, the protective layer is formed of N-methyltoxicated nylon, and acts so that the plastic substance of the electrically conductive elastic layer and the elastic layer of high resistance may not touch the photosensitive drum 7 to deteriorate the surface of the photosensitive drum 7.

The charging roller 8 is brought into contact with the photosensitive drum 7 and during image formation, the charging roller 8 rotates, following the rotation of the photosensitive drum 7, and at this time, a DC voltage and an AC voltage are superposed one upon the other and applied to the charging roller 8 to thereby uniformly charge the surface of the photosensitive drum 7.

(Exposure Portion)

The exposure portion 9 is for exposing the surface of the photosensitive drum 7 uniformly charged by the charging roller 8 to the optical image applied from the optical system 1 to thereby form an electrostatic latent image on the surface of the photosensitive drum 7. In the present embodiment, an opening 9 for directing the optical image is formed in the upper surface of the housing 12 as the cartridge frame to thereby provide the exposure portion.

(Developing Means)

The developing means 10, as shown in FIG. 2, contains the toner in the toner frame 12*a* for containing the toner, and a toner feeding member 10*a* for feeding out this toner is rotatably provided in the toner frame 12*a*. In the opening portion of the toner frame 12*a* which is adjacent to the photosensitive drum 7, a developing sleeve 10*c* having a non-rotatable magnet 10*b* therein and rotated to thereby form a thin toner layer on the surface thereof is provided at a minute interval with respect to the photosensitive drum 7.

The developing sleeve 10*c* is constructed by roughening the surface of a cylindrical member made of aluminum as by sand blast processing, and applying pigment-dispersed electrically conductive paint thereonto, and when a toner layer is formed on the surface of this developing sleeve 10*c*, triboelectric charges sufficient to develop the electrostatic latent image on the photosensitive drum 7 are obtained by the friction between the toner and the developing sleeve 10*c*. Also, in the toner frame 12*a*, there is provided a developing blade 10*d* for regulating the layer thickness of the toner on the surface of the developing sleeve 10*c*.

(Cleaning Means)

The cleaning means 11 serves to remove any toner remaining on the photosensitive drum 7, and as shown in FIG. 2, it is provided in the cleaning frame 12*b*. The cleaning means 11 is comprised of a cleaning blade 11*a* for contacting with the surface of the photosensitive drum 7, and scraping off and removing the toner remaining on the photosensitive drum 7, a dip sheet 11*b* located below the cleaning blade 11*a* to dip the scraped-off toner, and weakly contacting the surface of the photosensitive drum 7, and a removed toner reservoir 11*c* for collecting the dipped removed toner therein. The cleaning blade 11*a* is mounted on the cleaning frame 12*b* through a blade supporting member 11*d*.

{The Cutting and Disassembly of the Process Cartridge by a Laser}

A description will now be provided of the cutting and disassembling steps for the process cartridge B in recycle.

In case of the recycling of the process cartridge B, the constituent parts of the process cartridge B include various parts from relatively easily reusable parts, such as the charging roller 8, the toner feeding member 10*a*, the magnet 10*b* and the blade supporting member 11*d*, to parts like resin molded parts such as the toner frame 12*a* and the cleaning frame 12*b*, which are difficult to disassemble without being cut or destroyed, and are rather suited to be melted and recycled as a resin material.

So, in the present embodiment, a description will be provided of a process cartridge B of a construction in which the toner frame 12*a* is cut and disassembled to thereby enable the recyclable parts, i.e., the toner feeding member 10*a* and a toner feeding member driving gear 10*e*, to be easily taken out without being damaged, and a method of cutting the same.

Figure 3:
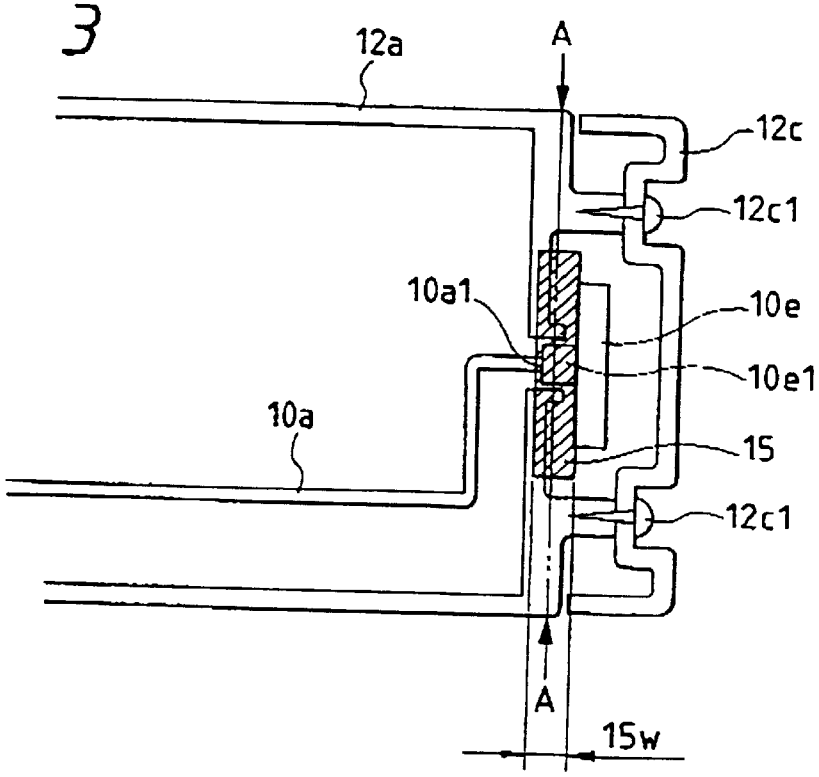
FIG. 3 is an illustration showing the construction of the process cartridge according to the first embodiment, and a cut position of the process cartridge.

FIG. 3 shows the construction of the toner frame 12*a* of the process cartridge B according to the present embodiment, and the cut position of the toner frame 12*a*. FIG. 3 is a view of the toner frame 12*a* of the process cartridge B as it is seen from the direction of arrows S1—S1 indicated in FIG. 2.

As shown in FIG. 3, a toner feeding member driving gear 10*e* for driving the toner feeding member 10*a* is provided on one lengthwise end portion of the toner frame 12*a* (one axial end portion of the photosensitive drum 7). The toner feeding member driving gear 10*e* is covered with a driving gear cover 12*c*, which is fastened to the toner frame 12*a* by a screw 12*c*1.

The toner frame 12*a* and the driving gear cover 12*c* are the outer packaging parts of the process cartridge B and therefore may have been damaged during transportation. Also, when the toner frame 12*a* is constructed by the welding of two or more resin molded parts, and thus even if the toner frame 12*a* is taken out without being damaged, it is difficult to use the toner frame 12*a* in the cartridge manufacturing process.

Accordingly, in such a case, it is more effective to pulverize the toner frame 12*a* and the driving gear cover 12*c* into pellets and recycle them as a resin material. Thus, as a method of taking out the toner feeding member 10*a* and the toner feeding member driving gear 10*e* to recycle them, it is not necessary to take the trouble to remove the screw 12*c*1 and separate the driving gear cover 12*c* and the toner frame 12*a*.

So, if the toner feeding member 10*a* and the toner feeding member driving gear 10*e* can be taken out without being damaged by cutting and destroying the toner frame 12*a* and the driving gear cover 12*c* by the use, for example, of a laser, it will become easy to taken out the toner feeding member 10*a* and the toner feeding member driving gear 10*e*. For this purposes, it is necessary to protect the toner feeding member 10*a* and the toner feeding member driving gear 10*e*, which are parts to be recycled, so as not to be cut by the laser. So, in the present embodiment, as protective means for the toner feeding member 10*a* and the toner feeding member driving gear 10*e*, a material layer 15 that is difficult to cut by the laser is provided in the toner frame 12*a* of the process cartridge B.

The cutting and disassembling step for the recycle of the process cartridge according to the present embodiment is provided with the following three steps: the cutting step of cutting the process cartridge B into at least several divisions, the disassembling step of disassembling the process cartridge B cut into the several divisions by the cutting step to constituent part units, and the sorting step of sorting the constituent parts of the process cartridge B disassembled by the disassembling step by the uses of the recycling. In the cutting step in the recycle process of the process cartridge B provided with these three steps, the process cartridge B is cut by the use of the laser.

In the present embodiment, metal foil is used as the material layer (hatched portion) 15 difficult to is cut by the laser. The metal foil 15, as shown in FIG. 3, is located at a place that does not cover a portion at which the process cartridge B is cut, i.e., the fastened portion of the toner frame 12*a* and the driving gear cover 12*c*, but covers the parts to be taken out without being damaged, i.e., the toner feeding member 10*a* and the toner feeding member driving gear 10*e*. More particularly, the metal foil 15 has a predetermined width 15*w* covering the range from the end portion 10*a*1 of the toner feeding member 10*a* to the toner feeding member bearing 10*e*1 of the toner feeding member driving gear 10*e*, and covers the end portion 10*a*1 of the toner feeding member 10*a* to the toner feeding member bearing 10*e*1.

The metal foil 15, as the material layer that is difficult to cut by the laser, is difficult to cut by the laser, as compared with the resin material of the parts to be cut, i.e., the toner frame 12*a* and the driving gear cover 12*c* formed of material layers that are easy to cut by the laser.

When the process cartridge B is to be cut by the use of the laser, the output of the laser is set to an output which cannot cut the metal foil 15, but yet can cut the resin material forming the toner frame 12*a* and the driving gear cover 12*c*. The process cartridge B is cut by the laser at a predetermined cut position A—A set so as to pass through the toner frame 12*a* and the driving gear cover 12*c* within the range of the width 15*w* of the metal foil 15.

As a result, the laser cuts only the toner frame 12*a* and the driving gear cover 12*c*, and the toner feeding member 10*a* and the toner feeding member driving gear 10*e* are protected from the cutting by the laser by the metal foil 15 over the range from the end portion 10*a*1 of the toner feeding member 10*a* to the toner feeding member bearing 10*e*1 of the toner feeding member driving gear 10*e* and therefore, the toner feeding member 10*a* and the toner feeding member driving gear 10*e* can be taken out from the toner frame 12*a* without being damaged.

Moreover, the cut position A—A by the laser may be anywhere within the range of the width 15*w* of the metal foil 15, and the high accuracy of the cut position is not required.

Also, the material layer 15 that is difficult to cut by the layer may be any material more difficult to cut by the laser than the resin material forming the toner frame 12*a* and the driving gear cover 12*c*, and may be, for example, ceramic sheets.

Also, the material layer 15 that is difficult to cut by the laser may be contained in advance in the toner frame 12*a* or the driving gear cover 12*c*, or may be of a construction that can be inserted from the outside immediately before cut by the laser.

Second Embodiment

In the present embodiment, a description will be provided of a process cartridge designed such that the toner feeding member and the toner feeding member driving gear, which are recyclable parts, are not cut, and the cutting and disassembling step for the recycle of this process cartridge.

The feature of the process cartridge B according to the present embodiment is that a material layer that is difficult to cut by the laser is disposed on the toner feeding member bearing of the recyclable part, i.e., the toner feeding member driving gear. Also, the feature of the cutting and disassembling step for the process cartridge B in the present embodiment is that the toner frame is cut and disassembled by the laser, whereby the recyclable part, i.e., the toner feeding member driving gear, can be taken out easily without being damaged.

Figure 4:
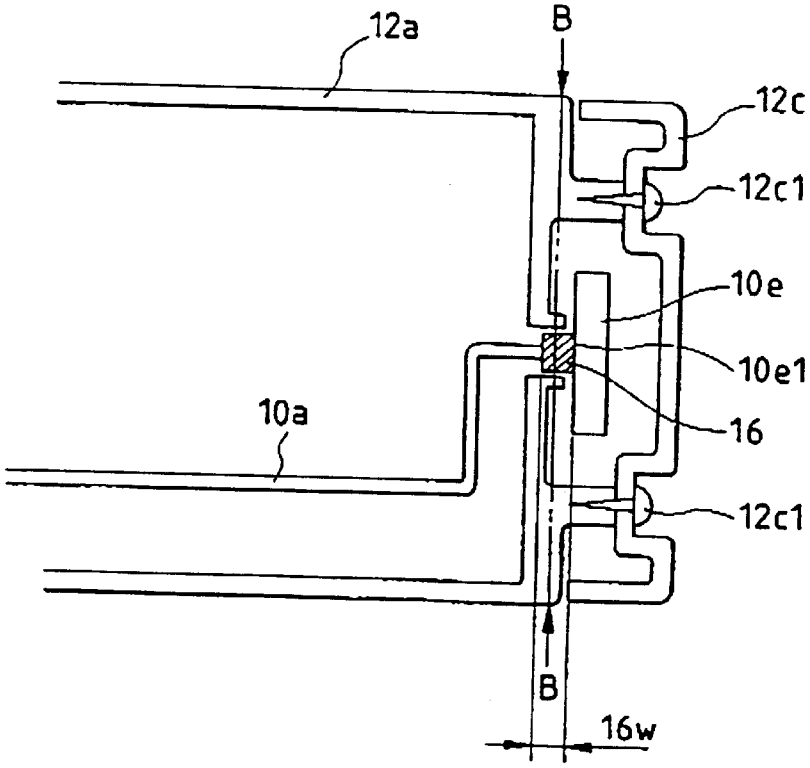
FIG. 4 is an illustration showing the construction of a process cartridge according to a second embodiment, and a cut position of the process cartridge.

FIG. 4 shows the construction of the toner frame 12*a* of the process cartridge B according to the present embodiment, and the cut position of the toner frame 12*a*. FIG. 4 is a view of the toner frame 12*a* of the process cartridge B as it is seen from the direction of arrows S1—S1 indicated in FIG. 2.

In the present embodiment, a thin film coating (hatched portion) 16, as a material layer that is difficult to cut by the laser, is provided on the toner feeding member bearing 10*e*1 of the toner feeding member driving gear 10*e* of the toner frame 12 of the process cartridge B. The thin film coating 16 is applied to the whole peripheral surface of the toner feeding member bearing 10*e*1. Accordingly, the thin film coating 16 has the same width 16*w* as the protrusion length of the toner feeding member bearing 10*e*1.

As the thin film coating 16, use is made of a metal film that is difficult to cut by the laser, as compared with the resin material of the parts to be cut, i.e., the toner frame 12*a* and the driving gear cover 12*c* comprising material layers that are easy to cut by the laser.

When the process cartridge B is to be cut by the use of the laser, the output of the laser is set to an output that cannot cut the thin film coating 16, but yet can cut the resin material forming the toner frame 12*a* and the driving gear cover 12*c*. The process cartridge B is cut by the laser at a predetermined cut position B—B set so as to pass through the toner frame 12*a* and the driving gear cover 12*c* within the range of the width 16*w* of the thin film coating 16.

As a result, the laser cuts only the toner frame 12*a* and the driving gear cover 12*c*, and the toner feeding member driving gear 10*e* can be taken out from the toner frame 12*a* without being damaged because the toner feeding member bearing 10*e*1 is protected from the cutting by the laser by the thin film coating 16.

Moreover, the cut position B—B by the laser may be anywhere within the range of the width 16*w* of the thin film coating 16 and the high accuracy of the cut position is not required.

Also, the thin film coating 16 as the material layer difficult to cut by the laser may be any material more difficult to cut by the laser than the resin material forming the toner frame 12*a* and the driving gear cover 12*c*, and may be, for example, ceramic film or the like.

Third Embodiment

In the present embodiment, a description will be provided of a process cartridge designed such that the recyclable part, i.e., the developing sleeve is not cut by the laser, and the cutting and disassembling step for the recycle of the process cartridge.

The feature of the process cartridge according to the present embodiment is that a material layer that is difficult to cut by the laser is disposed on the recyclable part, i.e., the developing sleeve. Also, the feature of the cutting and disassembling step for the process cartridge B in the present embodiment is that the toner frame is cut and disassembled by the laser, whereby the recyclable part, i.e, the developing sleeve, can be taken out easily without being damaged.

Figure 5:
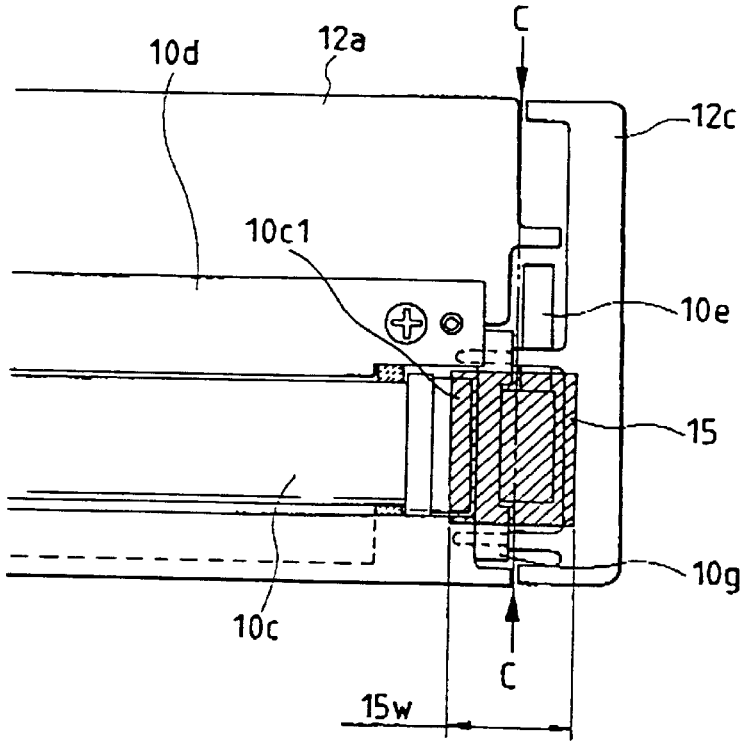
FIG. 5 is an illustration showing the construction of a process cartridge according to a third embodiment, and a cut position of the process cartridge.

FIG. 5 shows the construction of the toner frame 12*a* of the process cartridge B according to the present embodiment, and the cut position of this toner frame 12*a*. FIG. 5 is a view of the toner frame 12*a* of the process cartridge B as it is seen from the direction of arrows S2—S2 indicated in FIG. 2.

In the present embodiment, a material layer (hatched portion) 15 that is difficult to cut by the laser is metal foil, and the portion to be cut, i.e., the fastened portion of the driving gear cover 12*c* and the sleeve bearing 10*g*, Is not covered, but is located at a place covering the vicinity of the part to be taken out without being damaged, i.e., the sleeve bearing 10*g* of the developing sleeve 10*c*. More particularly, the metal foil 15 has a predetermined width 15*w* covering the range from the end portion 10*c*1 of the developing sleeve 10*c* to the sleeve bearing 10*g*, and covers the end portion 10*c*1 of the developing sleeve 10*c* and the sleeve bearing 10*g*.

The metal foil 15, as the material layer that is difficult to cut by the laser, is difficult to cut by the laser, as compared with the resin material of the part to be cut, i.e, the driving gear cover 12*c* comprising a material layer easy to cut by the laser.

When the process cartridge B is to be cut by the use of the laser, the output of the laser is set to an output that cannot cut the metal foil 15, but yet can cut the resin material forming the driving gear cover 12*c*. The process cartridge B is cut by the laser at a predetermined cut position C—C set so as to pass through the driving gear cover 12*c* within the range of the width 15*w* of the metal foil 15.

As a result, the laser cuts only the driving gear cover 12*c*, and the developing sleeve 10*c* can be taken out from the toner frame 12*a* without being damaged because the range from the end portion 10*c*1 of the developing sleeve 10*c* to the sleeve bearing 10*g* is protected from the cutting by the laser by the metal foil 15.

Moreover, the cut position C—C by the laser may be anywhere within the range of the width 15*w* of the metal foil 15, and high accuracy of the cut position is not required.

Also, the material layer that is 15 difficult to cut by the laser may be any material more difficult to cut by the laser than the resin material forming the driving gear cover 12*c*, and may be, for example, a ceramic sheet or the like.

Also, the material layer that is 15 difficult to cut by the laser may be contained in advance in the toner frame 12*a* or the driving gear cover 12*c*, or may be of a construction that can be inserted from the outside immediately before cut by the laser.

Fourth Embodiment

In the present embodiment, a description will be provided of a process cartridge designed such that the recyclable part, i.e., the magnet in the developing sleeve, is not cut by the laser and the cutting and disassembling step for the recycle of the process cartridge.

The feature of the process cartridge B according to the present embodiment is that a material layer that is difficult to cut by the laser is disposed on the recyclable part, i.e., the magnet contained in the developing sleeve. Also, the feature of the cutting and disassembling step for the process cartridge B in the present embodiment is that the toner frame is cut by the laser and disassembled, whereby the recyclable part, i.e, the magnet contained in the developing sleeve, can be taken out easily without being damaged.

Figure 6:
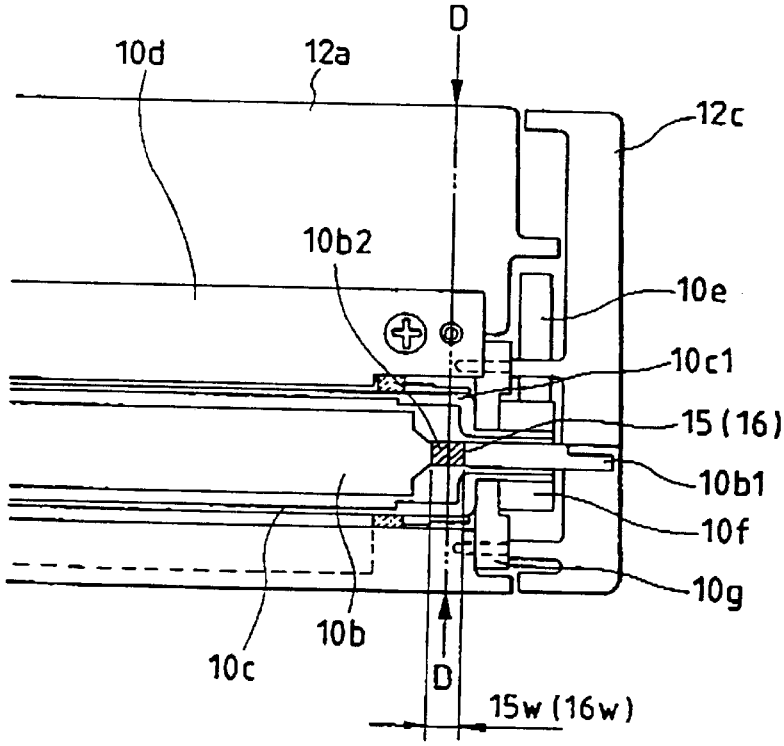
FIG. 6 is an illustration showing the construction of a process cartridge according to a fourth embodiment, and a cut position of the process cartridge.

FIG. 6 shows the construction of the toner frame 12*a* of the process cartridge B according to the present embodiment, and the cut position of the toner frame 12*a*. FIG. 6 is a view of the toner frame 12*a* of the process cartridge B as it is seen from the direction of arrows S3—S3 indicated in FIG. 2.

In the present embodiment, a material layer (hatched portion) 15 that is difficult to cut by the laser is metal foil, and is located at a place that does not cover the parts to be cut, i.e., the toner frame 12*a* and the developing sleeve 10*c*, but covers only the part to be taken out without being damaged, i.e., the magnet 10*b*. More particularly, the metal foil 15 has a predetermined width 15*w* covering a base 10*b*2 located in the end portion 10*c*1 of the developing sleeve 10*c* in the fixed shaft portion 10*b*1 of the magnet 10*b*, and covers this base 10*b*2.

The metal foil 15 as the material layer that is difficult to cut by the laser is difficult to cut by the laser, as compared with the material forming the parts to be cut, i.e., the toner frame 12*a* and the developing sleeve 10*c* comprising material layers easy to cut by the laser.

When the process cartridge B is to be cut by the use of the laser, the output of the laser is set to an output that cannot cut the metal foil 15, but yet can cut the toner frame 12*a* and the developing sleeve 10*c*. The process cartridge B is cut by the laser at a predetermined cut position D—D set so as to pass through the toner frame 12*a* and the developing sleeve 10*c* within the range of the width 15*w* of the metal foil 15.

As a result, the laser cuts only the toner frame 12*a* and the developing sleeve 10*c*, and the magnet 10*b* in the developing sleeve 10*c* can be taken out from the toner frame 12*a* without being damaged because the base 10*b*2 of the magnet 10*b* is protected from the cutting by the laser by the metal foil 15.

Moreover, the cut position D—D by the laser may be anywhere within the range of the width 15*w* of the metal foil 15, and high accuracy of the cut position is not required.

Also, the material layer 15 that is difficult to cut by the laser may be any material more difficult to cut by the laser than the material forming the toner frame 12*a* and the developing sleeve 10*c*, and may be, for example, a ceramic sheet or the like.

Also, instead of the metal foil or the ceramic sheet, a thin film coating 16 of a material that is difficult to cut by the laser may be provided on the base 10*b*2 of the magnet 10*b*. As the thin film coating 16, use is made of metal film that is difficult to cut by the laser, as compared with the material forming the parts to be cut, i.e., the toner frame 12*a* and the developing sleeve 10*c*.

When the thin film coating 16 is provided on the base 10*b*2 of the magnet 10*b*, the output of the laser used for the cutting of the process cartridge B is set to an output that cannot cut the thin film coating 16, but yet can cut the material forming the toner frame 12*a* and the developing sleeve 10*c*. The process cartridge B is cut by the laser at a predetermined cut position D—D set so as to pass through the toner frame 12*a* and the driving gear cover 12*c* within the range of the width 16*w* of the thin film coating 16.

As a result, the laser cuts only the toner frame 12*a* and the developing sleeve 10*c*, and the magnet 10*b* in the developing sleeve 10*c* can be taken out from the toner frame 12*a* without being damaged because the magnet 10*b* has its base 10*b*2 protected from the cutting by the laser by the thin film coating 16.

Moreover, the cut position D—D by the laser may be anywhere within the range of the width 16*w* of the thin film coating 16, and high accuracy of the cut position is not required.

Also, the thin film coating 16 of the material that is difficult to cut by the laser may be any material more difficult to cut by the laser than the material forming the toner frame 12*a* and the developing sleeve 10*c*, and may be, for example, ceramic film or the like.

Fifth Embodiment

In the present embodiment, a description will be provided of a process cartridge designed such that the recyclable part, i.e., the charging roller, is not cut by the laser, and the cutting and disassembling step for the recycle of the process cartridge.

The feature of the process cartridge B according to the present embodiment is that a material layer that is difficult to cut by the laser is disposed on the recyclable part, i.e., the charging roller. Also, the cutting and disassembling step for the process cartridge B in the present embodiment is that the is cleaning frame is cut and disassembled by the laser, whereby the recyclable part, i.e., the charging roller, can be taken out easily without being damaged.

Figure 7:
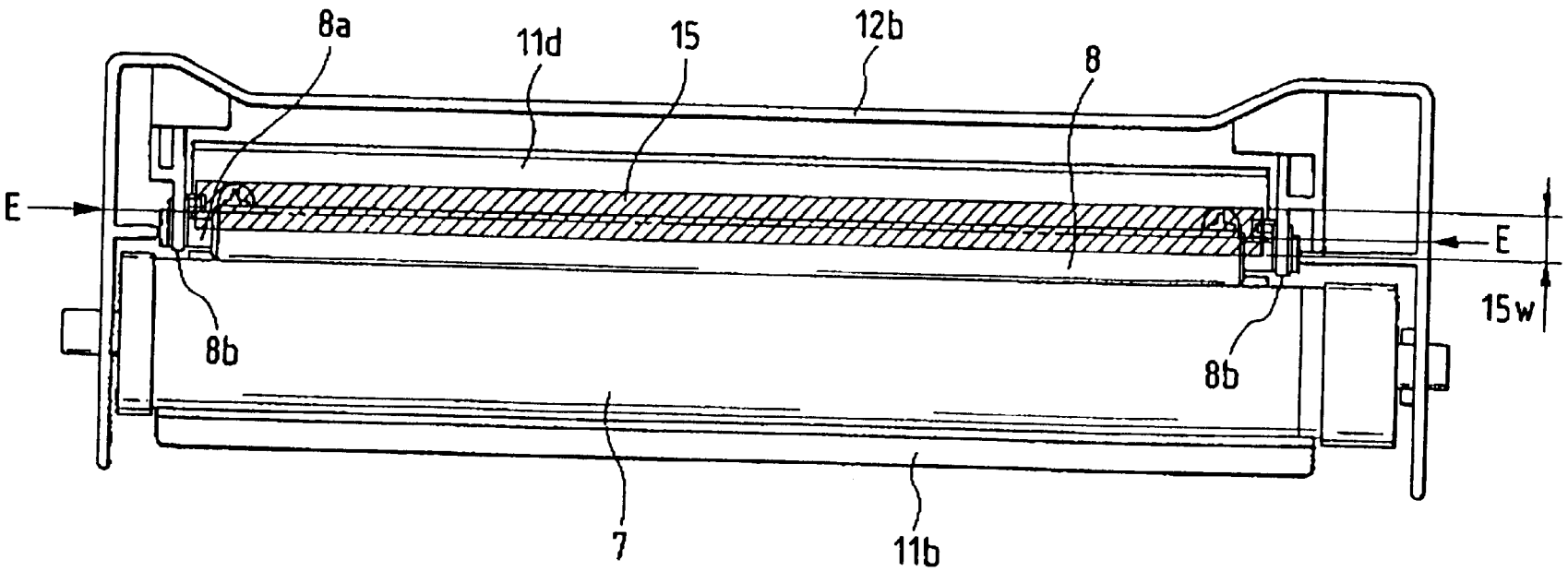
FIG. 7 is an illustration showing the construction of a process cartridge according to a fifth embodiment, and a cut position of the process cartridge.

FIG. 7 shows the construction of the cleaning frame 12*b* of the process cartridge B according to the present embodiment, and the cut position of the cleaning frame 12*b*. FIG. 7 is a view of the cleaning frame 12*b* of the process cartridge B as it is seen from the direction of arrows S4—S4 indicated in FIG. 2.

In the present embodiment, a material layer (hatched portion) 15 that is difficult to cut by the laser is metal foil, and is located at a place that does not cover the parts to be cut, i.e., the cleaning frame 12*b* and a charging roller bearing 8*b* rotatably supporting a charging roller shaft 8*a*, but covers only the part to be taken out without being damaged i.e., the charging roller 8. More particularly, the metal foil 15 has a predetermined width 15*w* covering the range from the axis (center line) of the charging roller 8 to the substantially central position of the blade supporting member 11*d*, and lengthwisely covers the diametrally upper half portion of the charging roller 8 together with the charging roller shaft 8*a*.

The metal foil 15, as the material layer that is difficult to cut by the laser, is difficult to cut by the laser, as compared with the resin material forming the parts to be cut, i.e., the cleaning frame 12*b* and the charging roller bearing 8*b* comprising material layers easy to cut by the laser.

When the process cartridge B is to be cut by the use of the laser, the output of the laser is set to an output that cannot cut the metal foil 15, but yet can cut the cleaning frame 12*b* and the charging roller bearing 8*b*. The process cartridge B is cut by the laser at a predetermined cut position E—E set so as to pass through the cleaning frame 12*b* and the charging roller bearing 8*b* within the range of the width 15*w* of the metal foil 15.

As a result, the laser cuts only the cleaning frame 12*b* and the charging roller bearing 8*b*, and the charging roller 8 and the charging roller shaft 8*a* can be taken out from the cleaning frame 12*b* without being damaged because the charging roller 8 and the charging roller shaft 8*a* are protected from the cutting by the laser by the metal foil 15.

Moreover, the cut position E—E by the laser may be anywhere within the range of the width 15*w* of the metal foil 15, and high accuracy of the cut position is not required.

Also, the material layer 15 that is difficult to cut by the laser may be any material that is more difficult to cut by the laser than the resin material forming the cleaning frame 12*b* and the charging roller bearing 8*b*, and may be, for example, a ceramic sheet or the like.

Also, the material layer 15 that is difficult to cut by the laser may be contained in advance in the cleaning frame 12*b*, or may be of a construction that can be inserted from the outside immediately before cut by the laser.

The process cartridges B as resin products according to the above-described first to fifth embodiments are of a construction in which a laser is used as cutting means for cutting the process cartridges B and of the constituent parts of the process cartridges B, the material layer 15(16) that cannot be cut by the laser is provided between the parts to be cut (the toner frame 12*a*, the driving gear cover 12*c*, etc.) and the parts not to be cut (the toner feeding member 10*a*, the toner feeding member driving gear 10*e*, the toner feeding member bearing 10*e*1, the developing sleeve 10*c*, the magnet 10*b*, etc.).

Thereby, when the process cartridges B are to be cut and disassembled for recycling, only the parts to be cut can be cut by the laser and therefore, the parts not to be cut, i.e., the parts that are to be disassembled and taken out and intactly recycled can be taken out from the housing 12 as the cartridge frame without being damaged.

Also, the material layer 15 (16) that cannot be cut by the laser has a predetermined width and therefore, when the process cartridges B are to be cut is and disassembled for recycling, even if the process cartridges B are cut with relatively rough positioning accuracy, it becomes possible to cut only the parts to be cut without injuring the parts not to be cut, i.e., the parts to be disassembled and taken out and intactly recycled. Consequently, the parts not to be cut, i.e., the parts to be disassembled and taken out and intactly recycled can be taken out from the housing 12 as the cartridge frame without being damaged.

Sixth Embodiment

In the present embodiment, a description will be provided of a process cartridge in which the toner frame and the cleaning frame are integrally coupled together by a metallic fastening pin and that is designed such that the recyclable part, i.e., the charging roller, is not cut by the laser, and the cutting step for the recycling of the process cartridge. In the present embodiment, members functionally similar to those of the electrophotographic image forming apparatus A and the process cartridge B shown in the aforedescribed first embodiment are given the same reference characters.

Figure 8:
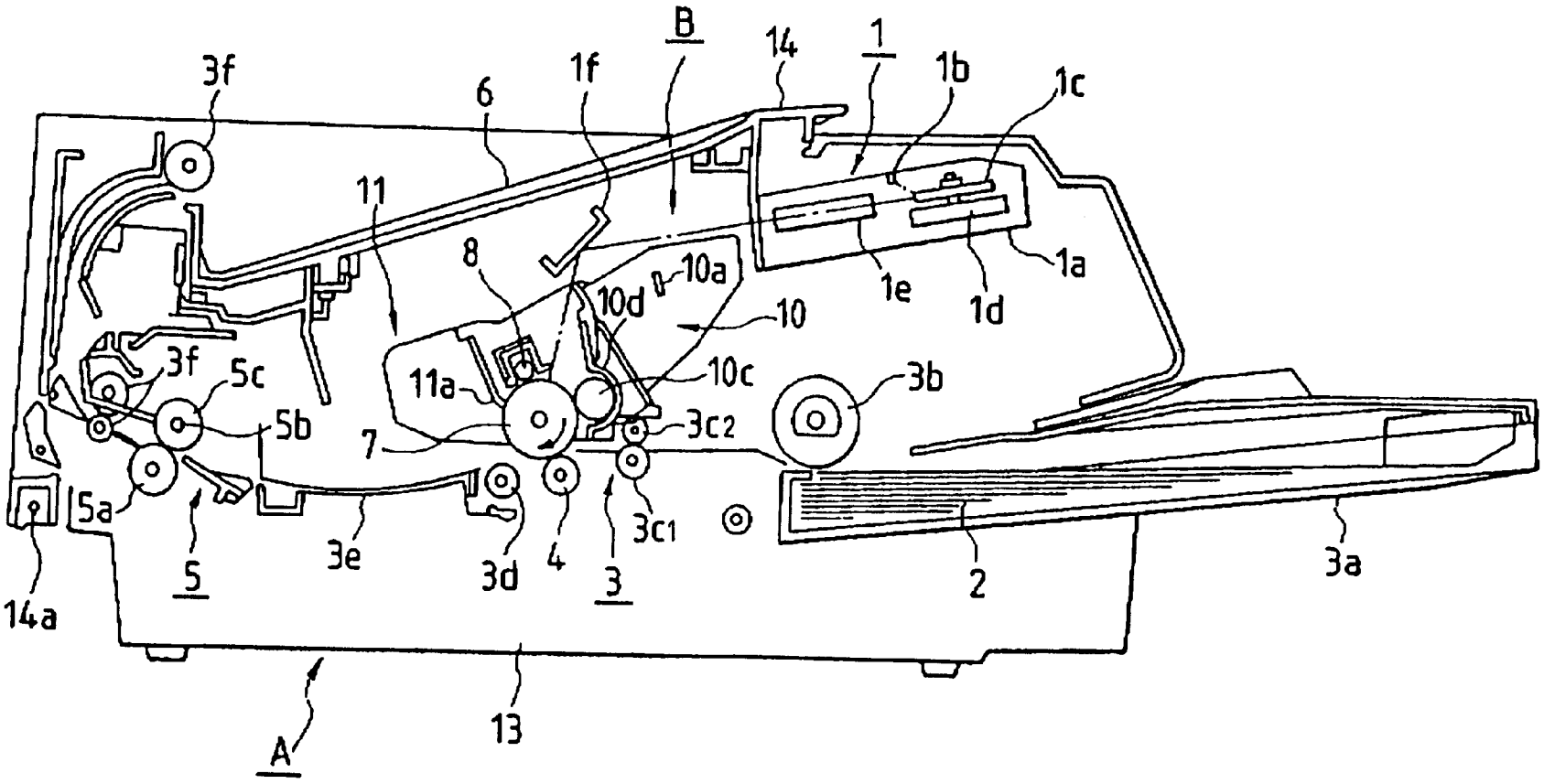
FIG. 8 is a typical illustration showing the construction of an electrophotographic image forming apparatus according to a sixth embodiment.
Figure 9:
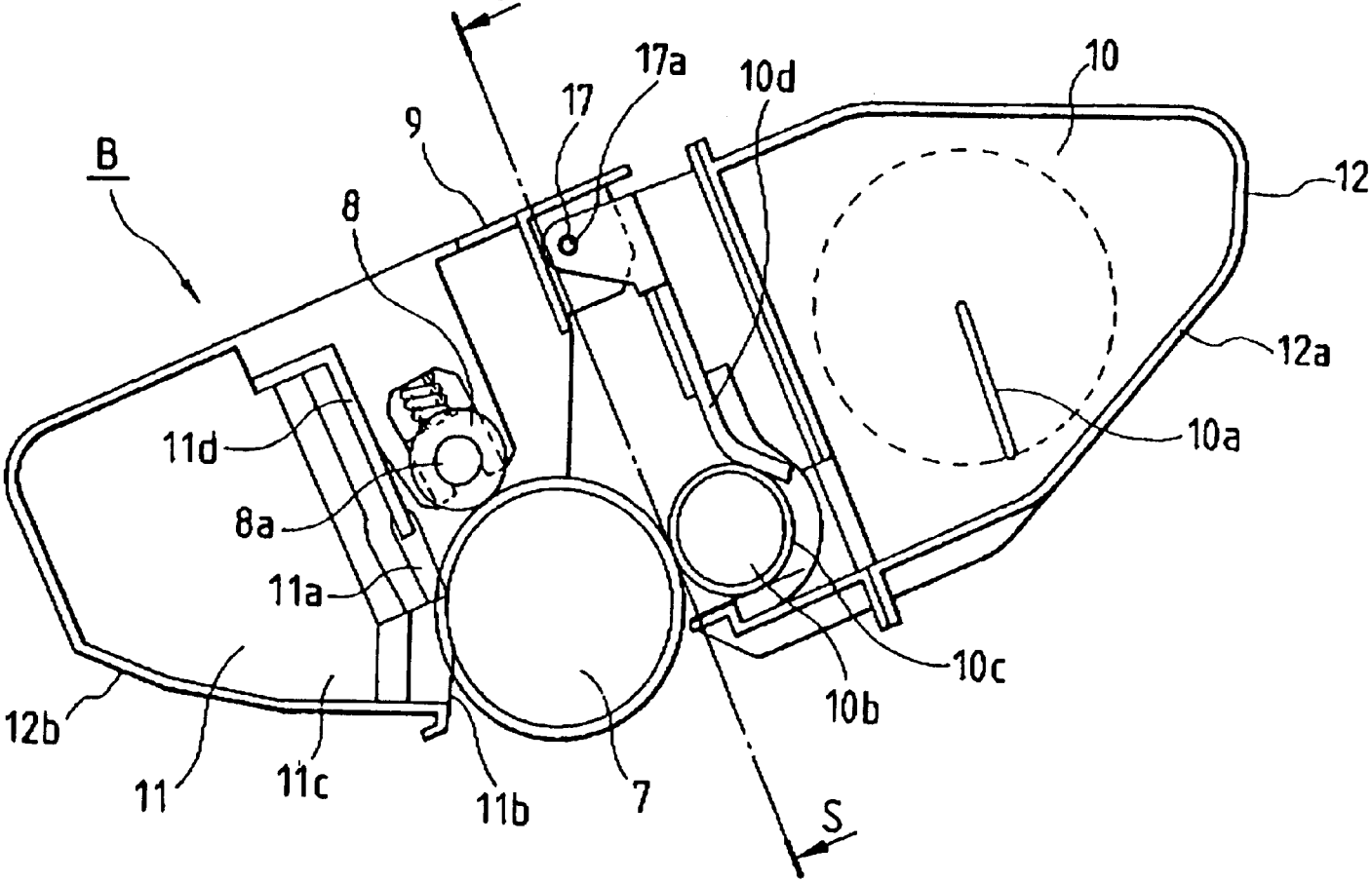
FIG. 9 is a typical illustration showing the construction of a process cartridge according to the sixth embodiment.

The process cartridge B according to the present embodiment, as shown in FIG. 9, has a toner frame 12*a* and a cleaning frame 12*b* that are resin molded members constituting the housing 12 as the cartridge frame. The toner frame 12*a* and the cleaning frame 12*b* are integrally coupled together by a metallic fastening pin 17*a* at fastening portions 17 provided on the lengthwisely opposite end portions of the process cartridge B (the axially opposite end portions of the photosensitive drum 7). More particularly, the fastening pin 17a is forced into round holes (not shown) formed in the toner frame 12*a* and the cleaning frame 12*b*, whereby the toner frame 12*a* and the cleaning frame 12*b* are integrally coupled together. The cleaning frame 12*b* has fastening portions (supporting portions) 18 (see FIG. 10) with respect to the photosensitive drum 7 on the lengthwisely opposite outer sides of the process cartridge B, and the drum shaft (not shown) of the photosensitive drum 7 is rotatably forced into the fastening portions 18. The process cartridge B is detachably mounted to the main body 13 of the electrophotographic image forming apparatus A shown in FIG. 8.

The mounting and dismounting of the process cartridge B with respect to the main body 13 of the apparatus are effected by opening the openable and closable cover 14. That is, the openable and closable cover 14 openable and closable by a hinge 14*a* is attached to the upper portion of the main body 13 of the apparatus. When the openable and closable cover 14 is opened, a cartridge mounting space (not shown) is provided in the main body 13 of the apparatus, and guide members, not shown, are attached to the right and left wall surfaces of the main body 13 of the apparatus which define the cartridge mounting space. Guides for mounting the process cartridge B are provided on these guide members, and by inserting the process cartridge B along the guides, and closing the openable and closable cover 14, the process cartridge B may be mounted to the main body 13 of the apparatus.

The electrophotographic image forming apparatus A according to the present embodiment, like the electrophotographic image forming apparatus A according to the aforedescribed first embodiment, applies an optical image based on image information from the optical system 1 and forms a developer (hereinafter referred to as the "toner") image on a drum-shaped electrophotographic photosensitive member (hereinafter referred to as the "photosensitive drum") 7 in the process cartridge B. A recording medium 2 is conveyed by conveying means 3 in synchronism with the formation of the toner image, and the toner image formed on the photosensitive drum 7 in the process cartridge B is transferred to the recording medium 2 by transfer means 4. The recording medium 2 is then conveyed to fixing means 5, whereby the transferred toner image is fixed and the recording medium 2 is discharged to a discharge portion 6. The constructions of the optical system 1, the conveying means 3, the transfer means 4 and the fixing means 5 are the same as those in the electrophotographic image forming apparatus A according to the first embodiment and therefore need not be described.

{Cutting and Disassembly of the Process Cartridge by a Laser}

There is a charging roller 8 as one of long-life parts constituting the process cartridge B, and this is suited for recycling.

So, in the present embodiment, a description will be provided of a process cartridge B of a construction in which the cleaning frame 12*b* is cut and disassembled, whereby the charging roller 8 can be taken out easily without being damaged, and a cutting method therefor.

Figure 10:
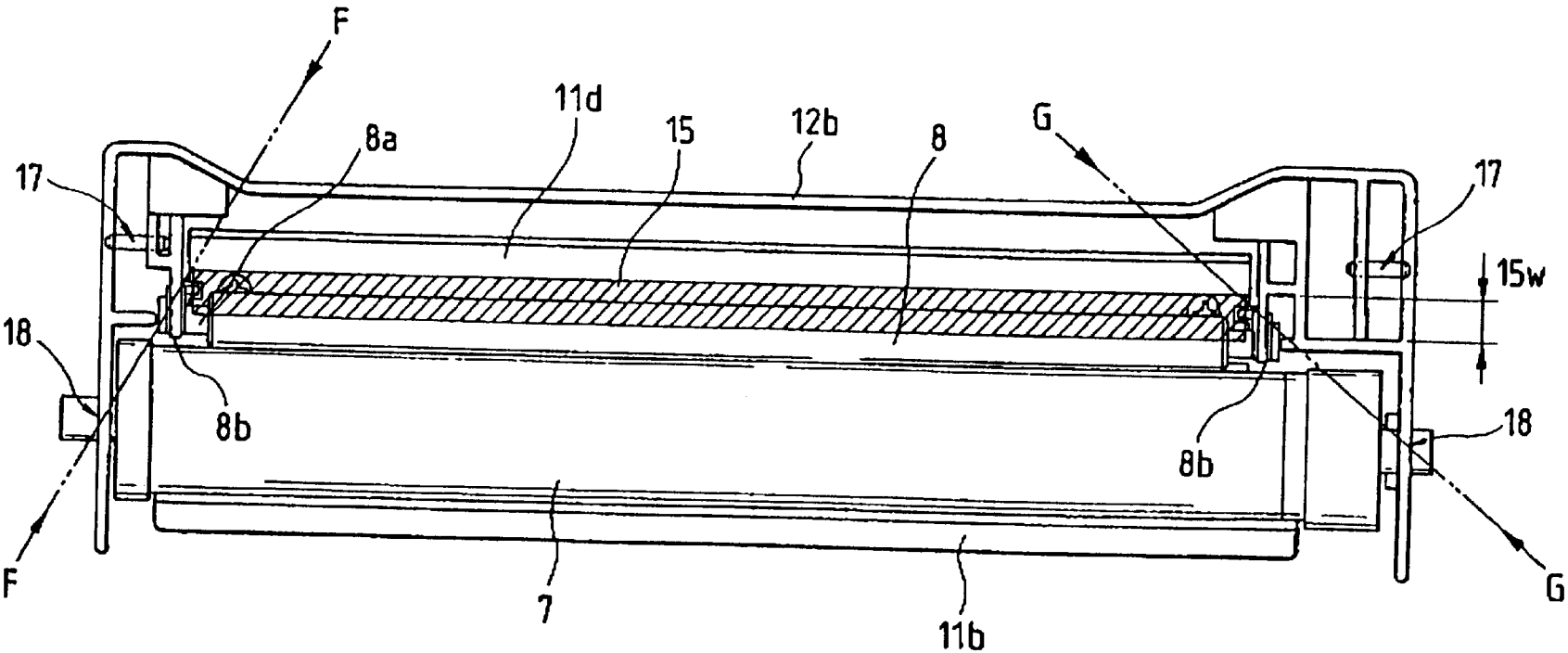
FIG. 10 is an illustration showing the construction of the process cartridge according to the sixth embodiment, and a cut position of the process cartridge.

FIG. 10 shows the construction of the cleaning frame 12*b* of the process cartridge B according to the present embodiment, and the cut position of this cleaning frame 12*b*. FIG. 10 is a view of the cleaning frame 12*b* of the process cartridge B as it is seen from the direction of arrows S—S indicated in FIG. 9.

The cleaning frame 12*b* is the outer packaging part of the process cartridge B and therefore may have been damaged during transportation. Also, the fastening portion 17 between the cleaning frame 12*b* and the toner frame 12*a* is fastened by a force-fitting of a resin molded part and a metallic fastening pin 17*a*, and the fastening portion 18 between the cleaning frame 12*b* and the photosensitive drum 7 is fastened by a force-fitting of the resin molded part and a metallic drum shaft. Therefore, it is difficult to disassemble the cleaning frame 12*b* without damaging it, and it is difficult to use the disassembled and taken-out cleaning frame 12*b* in the manufacturing process for a new cartridge.

Accordingly, in such a case, it is more effective to pulverize the cleaning frame 12*b* into pellets and recycle it as a resin material. Accordingly, as a method of taking out the charging roller 8 to recycle it, it is not necessary to take the trouble to detach the fastening pin 17*a* and separate the cleaning frame 12*b*, but as by cutting and destroying the cleaning frame 12*b*, the charging roller 8 can be taken out without being damaged.

So, if as in the aforedescribed fifth embodiment, the cleaning frame 12*b* is cut and destroyed, for example, by the use of a laser, whereby the charging roller 8 can be taken out without being injured, the taking-out of the charging roller will become easy. For that purpose, it is necessary to protect the charging roller 8 which is a recyclable part from being cut by the laser. So, in the present embodiment, as protecting means for the charging roller 8, a material layer (hatched portion) 15 difficult to cut by the laser is provided in the cleaning frame 12*b* of the process cartridge B.

In the present embodiment, metal foil is used as the material layer 15 that is difficult to cut by the laser. The metal foil 15 is located at a place that does not cover the parts to be cut, i.e., the cleaning frame 12*b* and the charging roller bearing 8*b* rotatably supporting the charging roller shaft 8*a*, but covers only the part to be taken out without being damaged, i.e., the charging roller 8 as shown in FIG. 10. More particularly, the metal foil 15 has a predetermined width 15*w* covering the range from the axis (center line) of the charging roller 8 to the substantially central position of the blade supporting member 11*d*, and lengthwisely covers the upper half portion of the charging roller 8 together with the charging roller shaft 8*a*.

The metal foil 15, as the material layer that is difficult to cut by the laser, is difficult to cut by the laser, as compared with the resin material forming the parts to be cut, i.e., the cleaning frame 12*b* and the charging roller bearing 8*b*.

When the process cartridge B is to be cut by the use of the laser, the output of the laser is set to an output which cannot cut the metal foil 15, but yet can cut the resin material forming the cleaning frame 12*b* and the charging roller bearing 8*b*. The process cartridge B is then cut by the laser at predetermined cut positions F—F and G—G set so as to pass through the cleaning frame 12*b*, the metal foil 15, the charging roller bearing 8*b* and the fastening portion 18 of the cleaning frame 12*b* and the photosensitive drum 7.

That is, the disassembling method for the process cartridge B according to the present embodiment has the cutting step of cutting the process cartridge B into several divisions by the use of the laser so as to pass through the metal foil 15 disposed on the charging roller 8 to thereby take out the charging roller 8.

As a result, the laser cuts only the cleaning frame 12*b*, the charging roller bearing 8*b* and the fastening portion 18 of the cleaning frame 12*b* and the photosensitive drum 7, and the charging roller 8 and the charging roller shaft 8*a* can be taken out from the cleaning frame 12*b* without being damaged because the charging roller 8 and the charging roller shaft 8*a* are protected from the cutting by the laser by the metal foil 15.

The cut positions F—F and G—G also cut the fastening portion 18 of the cleaning frame 12*b* and the photosensitive drum 7 and therefore, the photosensitive drum 7 can be taken out from the cleaning frame 12*b*, and then the charging roller 8 can also be taken out easily.

Moreover, the cut positions F—F and G—G may be anywhere within a range that passes through the metal foil 15 and can cut the portions to be cut, i.e., the cleaning frame 12*b*, the charging roller bearing 8*b* and the fastening portion 18 of the cleaning frame 12*b* and the photosensitive drum 7, and high accuracy of the cut positions is not required.

Also, the material layer 15 that is difficult to cut by the laser may be any material more difficult to cut by the laser than the resin material forming the cleaning frame 12*b* and the charging roller bearing 8*b*, and may be, for example, a ceramic sheet or the like.

Also, the material layer 15 that is difficult to cut by the laser may be contained in advance in the cleaning frame 12*b*, or may be of a construction that can be inserted from the outside immediately before cut by the laser.

Seventh Embodiment

In the present embodiment, a description will be provided of another example of the process cartridge according to the aforedescribed sixth embodiment, which is designed such that the recyclable part, i.e., the charging roller is not cut by the laser, and the cutting step for the recycling of the process cartridge.

The feature of the process cartridge B according to the present embodiment is that in the recyclable part, i.e., the charging roller, a material layer that is difficult to cut by the laser is disposed on the charging roller shaft of the charging roller. Also, the feature of the cutting step for the process cartridge B in the present embodiment is that the cleaning frame is cut and disassembled by the laser, whereby the recyclable part, i.e., the charging roller, can be taken out easily without being damaged.

Figure 11:
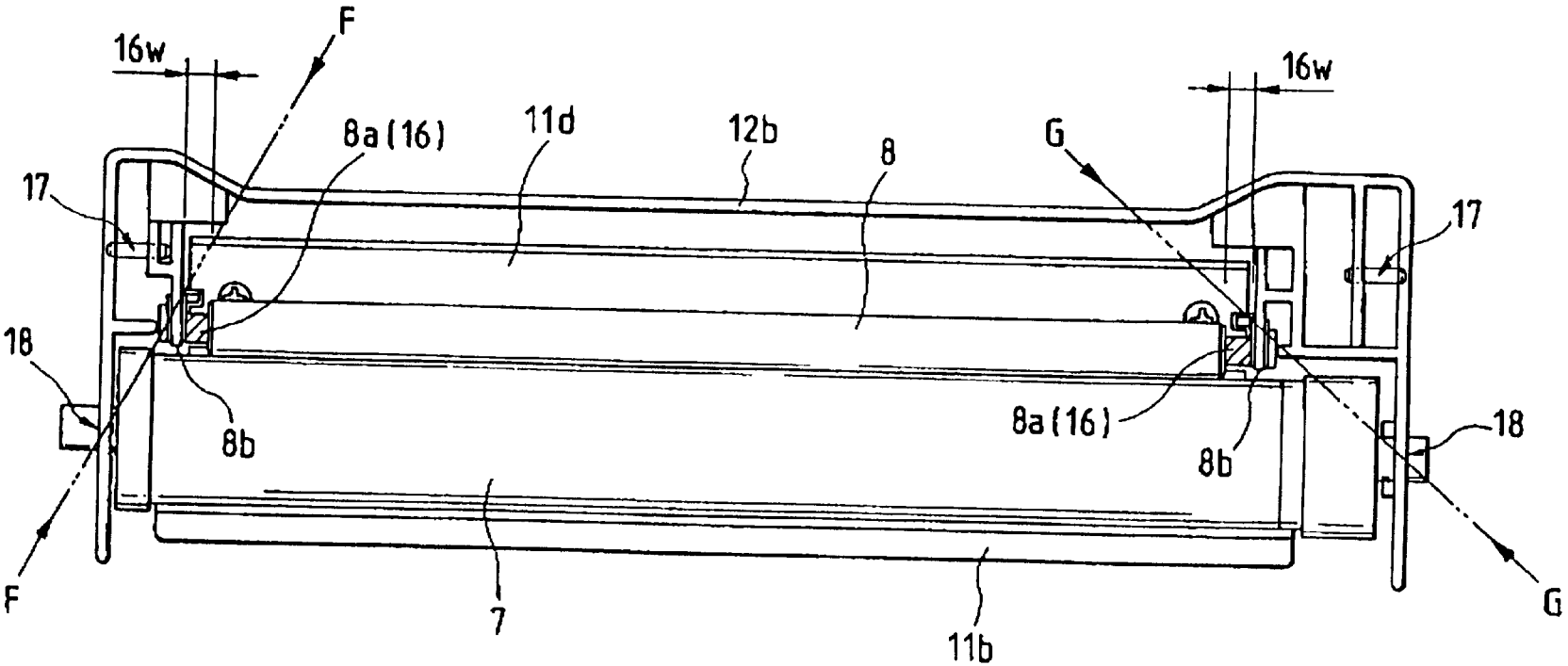
FIG. 11 is an illustration showing the construction of a process cartridge according to a seventh embodiment, and a cut position of the process cartridge.

FIG. 11 shows the construction of the cleaning frame 12*b* of the process cartridge B according to the present embodiment, and the cut position of the cleaning frame 12*b*. FIG. 11 is a view of the cleaning frame 12*b* of the process cartridge B as it is seen from the direction of arrows S—S indicated in FIG. 9.

In the present embodiment, a thin film coating (hatched portion) 16 of a material that is difficult to cut by the laser is provided on the charging roller shaft 8*a* of the charging roller 8. This thin film coating 16 is applied to the whole peripheral surface of the toner feeding member bearing 10*e*1. Accordingly, the thin film coating 16 has the same width 16*w* as the length of the charging roller shaft 8*a*.

As the thin film coating 16, use is made of metal film having a nature difficult to cut by the laser, as compared with the resin material forming the parts to be cut, i.e, the cleaning frame 12*b* and the charging roller bearing 8*b*.

When the process cartridge B is to be cut by the use of the laser, the output of the laser is set to an output that cannot cut the thin film coating 16, but yet can cut the resin material forming the cleaning frame 12*b* and the charging roller bearing 8*b*. The process cartridge B is then cut by the laser at predetermined cut positions F—F and G—G set so as to pass through the cleaning frame 12*b*, the thin film coating 16, the charging roller bearing 8*b* and the fastening portion 18 of the cleaning frame 12*b* and the photosensitive drum 7.

That is, the disassembling method for the process cartridge B according to the present embodiment has the cutting step of cutting the process cartridge B into several divisions by the use of the laser so as to pass through the thin film coating 16 applied to the charging roller shaft 8*a* of the charging roller 8, As a result, the laser cuts only the cleaning frame 12*b*, the charging roller bearing 8*b* and the fastening portion 18 of the cleaning frame 12*b* and the photosensitive drum 7, and the charging roller 8 and the charging roller shaft 8*a* can be taken out from the cleaning frame 12*b* without being damaged because the charging roller shaft 8*a* is protected from the cutting by the laser by the thin film coating 16.

The cut positions F—F and G—G also cut the fastening portion 18 of the cleaning frame 12*b* and the photosensitive drum 7 and therefore, the photosensitive drum 7 can be taken out from the cleaning frame 12*b*, and then the charging roller 8 can also be taken out easily.

Moreover, the cut positions F—F and G—G by the laser may be anywhere within the range that passes through the thin film coating 16 within the range of the width 16*w* and can cut the portions to be cut, i.e., the cleaning frame 12*b*, the charging roller bearing 8*b* and the fastening portion 18 of the cleaning frame 12*b* and the photosensitive drum 7, and high accuracy of the cut positions is not required.

Also, the thin film coating 16 of the material that is difficult to cut by the laser may be any material more difficult to cut by the laser than the resin material forming the cleaning frame 12*b* and the charging roller bearing 8*b*, and may be, for example, ceramic film or the like.

Also, when the material of the charging roller shaft 8*a* is a material sufficiently more difficult to cut by the laser than the resin material forming the cleaning frame 12*b* and the charging roller bearing 8*b*, it is not necessary to provide the thin film coating 16.

The process cartridges B according to the aforedescribed sixth and seventh embodiments are of a construction in which a laser is used as the cutting means for cutting the process cartridge B and of the constituent parts of the process cartridge B, the material layer 15(16) that cannot be cut by the laser is disposed on the parts not to be cut (the charging roller 8, etc.).

As a result, when the process cartridge B is to be cut and disassembled for recycling, only the parts to be cut (the cleaning frame 12*b*, the charging roller bearing 8*b*, the fastening portion 18, etc.) can be cut by the laser and therefore, the parts not to be cut, i.e, the parts to be disassembled and taken out and intactly recycled can be taken out from the housing 12 as the cartridge frame without being damaged.

Also, the material layer 15(16) that cannot be cut by the laser has a predetermined width and therefore, when the process cartridge B is to be cut and disassembled for recycling, even if the process cartridge B is cut with relatively rough positioning accuracy, it becomes possible to cut only the parts to be cut without damaging the parts not to be cut, i.e., the parts to be disassembled and taken out and intactly recycled. Consequently, the parts not to be cut, i.e., the parts to be disassembled and taken out and Intactly recycled, can be taken out from the housing 12 as the cartridge frame without being injured. Of course, as required, the taken-out parts are subjected to the recycling step of cleaning or polishing the surfaces thereof in case of recycling them.

In each of the aforedescribed embodiments, the parts taken out from the process cartridge are subjected to a worker's visual observation or/and an inspection such as the inspection by an inspecting apparatus. Only the parts that have passed the inspection are recycled. Also, the parts taken out from the cartridge are subjected to the recycling step of cleaning or polishing the surfaces thereof in case of recycling them, as required.

Other Embodiments

While the process cartridges shown in the aforedescribed embodiments have been exemplified with respect to a case where monochromatic images are formed, the present invention can also be suitably applied to a process cartridge provided with a plurality of developing means for forming images of plural colors (two-color images, three-color images or full-color images).

The disassembling method for the process cartridge shown in each of the aforedescribed embodiments can also be suitably applied to a disassembling method for a cartridge provided with a plurality of developing means for forming images of plural colors (two-color images, three-color images or full-color images).

Also, while in the aforedescribed embodiments, process cartridges have been exemplified as resin products, the resin products according to the present invention include, besides the aforedescribed process cartridges, for example, the main body of an image forming apparatus, i.e., a printer or a copier, a developing cartridge having a toner containing portion and developing means and detachably mountable to the main body of the image forming apparatus, or an instant camera or the like.

The electrophotographic photosensitive member is not restricted to the photosensitive drum, but includes the following. First, as the photosensitive drum, use is made of a photoconductor, and as the photoconductor, mention may be made, for example, amorphous silicon, amorphous selenium, zinc oxide, titanium oxide or organic photoconductor (OPC). Also, the shape carrying the photosensitive member may be, for example, a drum shape or a belt shape, and for example, in a drum type photosensitive member, a photoconductor is deposited by evaporation or applied onto a cylinder of an aluminum alloy or the like.

Also, as a method of removing the toner remaining on the photosensitive drum, cleaning means may be constructed by the use of a blade, a fur brush, a magnetic brush or the like.

Also, the aforedescribed process cartridge is provided, for example, with an electrophotographic photosensitive member and at least one of process means. Accordingly, the forms of the process cartridge include, besides the aforedescribed embodiments, for example, a form in which the electrophotographic photosensitive member and charging means are integrally made into a cartridge detachably mountable to the main body of the apparatus, a form in which the electrophotographic photosensitive member and developing means are integrally made into a cartridge detachably mountable to the main body of the apparatus, a form in which the electrophotographic photosensitive member and cleaning means are integrally made into a cartridge detachably mountable to the main body of the apparatus, and a form in which the electrophotographic photosensitive member and at least two of process means are integrally made into a cartridge detachably mountable to the main body of the apparatus.

That is, the aforedescribed process cartridge refers to the charging means, the developing means or the cleaning means and the electrophotographic photosensitive member integrally made into a cartridge detachably mountable to the main body of the image forming apparatus, or at least one of the charging means, developing means and cleaning means and the electrophotographic photosensitive member integrally made into a cartridge detachably mountable to the main body of the image forming apparatus, or at least the developing means and the electrophotographic photosensitive member integrally made into a cartridge detachably mountable to the main body of the apparatus. This process cartridge can be mounted and dismounted with respect to the main body of the apparatus by a user himself. So, the maintenance of the main body of the apparatus can be done by the user himself.

Further, while in the aforedescribed embodiments, a laser beam printer has been exemplified as the electrophotographic image forming apparatus, the present invention need not be limited thereto, but of course, the present invention can also be used, for example, in an electrophotographic copier, a facsimile apparatus or an electrophotographic image forming apparatus such as a word processor.

As described above, the resin product according to the present invention can be taken out easily without the parts to be recycled being damaged.

Also, according to the disassembling method for the resin product according to the present invention, the parts to be recycled can be taken out easily without being damaged.

Also, the process cartridge according to the present invention can be taken out easily without the parts to be recycled being damaged.

Also, according to the disassembling method for the process cartridge according to the present invention, the parts to be recycled can be taken out easily without being damaged.

Also, according to the disassembling method for the process cartridge according to the present invention, the parts of the charging means to be recycled can be taken out easily without being damaged.

Also, according to the process cartridge according to the present invention, the parts of the charging means to be recycled can be taken out easily without being damaged.

Also, according to the electrophotographic image forming apparatus according to the present invention, the process cartridge from which the parts of the charging means to be recycled can be taken out easily without being damaged can be detachably mounted to the apparatus.

While the invention has been described with reference to the structures disclosed herein, it is not confirmed to the details set forth and this application is intended to cover such modifications or changes as may come within the purposes of the improvements or the scope of the following claims.

What is claimed is:

1. A resin product having at least two resin molded parts and a recyclable part as constituent parts, said resin product comprising a material layer easy to cut by a laser and a material layer difficult to cut by said laser, the material layer difficult to cut by said laser being disposed so that said recyclable part may not be cut by use of said laser, the material layer easy to cut by said laser being constructed so as to be cut by said laser.

2. A resin product according to claim 1, wherein the material layer difficult to cut by said laser is disposed with a predetermined width so that said recyclable part may not be cut by said laser.

3. A resin product according to claim 1, wherein the material layer difficult to cut by said laser is metal film.

4. A resin product according to claim 1, wherein the material layer difficult to cut by said laser is metal foil.

5. A resin product according to claim 1, wherein the material layer difficult to cut by said laser is ceramic film.

6. A resin product according to claim 1, wherein the material layer difficult to cut by said laser is a ceramic sheet.

7. A method of disassembling a resin product having at least two resin molded parts and a recyclable part as constituent parts, said method comprising a cutting step of cutting said resin product into at least several divisions, a disassembling step of disassembling said resin product cut into the several divisions by said cutting step to units of the constituent parts, and a sorting step of sorting the constituent parts of said resin product disassembled by said disassembling step by their uses in recycling, wherein said resin product comprises a material layer easy to cut by a laser and a material layer difficult to cut by said laser, whereby in cutting at said cutting step, the material layer easy to cut by said laser is cut by use of said laser.

8. A method of disassembling a resin product according to claim 7, wherein the material layer difficult to cut by said laser is disposed so that said recyclable part may not be cut without being pulverized or melted after said disassembling step.

9. A method of disassembling a resin product according to claim 7, wherein the material layer difficult to cut by said laser is metal film.

10. A method of disassembling a resin product according to claim 7, wherein the material layer difficult to cut by said laser is metal foil.

11. A method of disassembling a resin product according to claim 7, wherein the material layer difficult to cut by said laser is ceramic film.

12. A method of disassembling a resin product according to claim 7, wherein the material layer difficult to cut by said laser is a ceramic sheet.

13. A process cartridge detachably mountable to a main body of an electrophotographic image forming apparatus, said process cartridge comprising an electrophotographic photosensitive member, process means acting on said electrophotographic photosensitive member, and a cartridge frame for supporting said electrophotographic photosensitive member and said process means, wherein said process cartridge comprises at least two resin molded parts and a recyclable part, and comprises a material layer easy to cut by a laser and a material layer difficult to cut by said laser, the material layer difficult to cut by said laser being disposed so that said recyclable part may not be cut by use of said laser, and the material layer easy to cut by said laser being constructed so as to be cut by the use of said laser.

14. A process cartridge according to claim 13, wherein the material layer difficult to cut by said laser is disposed with a predetermined width so that said recyclable part may not be cut by said laser.

15. A process cartridge according to claim 13, wherein the material layer difficult to cut by said laser is metal film.

16. A process cartridge according to claim 13, wherein the material layer difficult to cut by said laser is metal foil.

17. A process cartridge according to claim 13, wherein the material layer difficult to cut by said laser is ceramic film.

18. A process cartridge according to claim 13, wherein the material layer difficult to cut by said laser is a ceramic sheet.

19. A process cartridge according to claim 13, wherein said process means have at least any one of charging means for charging said electrophotographic photosensitive member, developing means for developing an electrostatic latent image formed on said electrophotographic photosensitive member by a developer, and cleaning means for removing the developer remaining on said electrophotographic photosensitive member.

20. A method of disassembling a process cartridge detachably mountable to a main body of an electrophotographic image forming apparatus, said method comprising a cutting step of cutting said process cartridge supporting an electrophotographic photosensitive member and process means acting on said electrophotographic photosensitive member, and having at least two resin molded parts and a recyclable part as constituent parts into at least several divisions, a disassembling step of disassembling said process cartridge cut into the several divisions by said cutting step to units of the constituent parts, and a sorting step of sorting the constituent parts of said process cartridge disassembled by said disassembling step by their uses in recycling, wherein said process cartridge comprises a material layer easy to cut by a laser and a material layer difficult to cut by said laser, whereby in cutting at said cutting step, the material layer easy to cut by said laser is cut by use of said laser.

21. A method of disassembling a process cartridge according to claim 20, wherein the material layer difficult to cut by said laser is disposed so that said recyclable part may not be cut without being pulverized or melted after said disassembling step.

22. A method of disassembling a process cartridge according to claim 20, wherein the material layer difficult to cut by said laser is metal film.

23. A method of disassembling a process cartridge according to claim 20, wherein the material layer difficult to cut by said laser is metal foil.

24. A method of disassembling a process cartridge according to claim 20, wherein the material layer difficult to cut by said laser is ceramic film.

25. A method of disassembling a process cartridge according to claim 20, wherein the material layer difficult to cut by said laser is a ceramic sheet.

26. A method of disassembling a process cartridge detachably mountable to a main body of an electrophotographic image forming apparatus, said method comprising a cutting step of cutting the process cartridge having an electrophotographic photosensitive member, charging means for charging said electrophotographic photosensitive member, and a material layer difficult to cut by a laser disposed in said charging means by use of said laser so as to pass through the material layer difficult to cut by said laser, thereby taking cut at least one part constituting said charging means.

27. A method of disassembling a process cartridge according to claim 26, wherein the part constituting said charging means and taken out by cutting said process cartridge is a recyclable part.

28. A method of disassembling a process cartridge according to claim 26, wherein the part constituting said charging means and taken out by cutting said process cartridge is a charging roller.

29. A method of disassembling a process cartridge according to claim 26, wherein said process cartridge comprises a material layer easy to cut by the laser, and is designed such that in cutting at said cutting step, the material layer easy to cut by said laser is cut by use of said laser.

30. A method of disassembling a process cartridge according to claim 26, wherein the material layer difficult to cut by said laser is disposed so that a recyclable part constituting said charging means may not be cut at said cutting step.

31. A method of disassembling a process cartridge according to claim 26, wherein the material layer difficult to cut by said laser is metal film.

32. A method of disassembling a process cartridge according to claim 26, wherein the material layer difficult to cut by said laser is a metal sheet.

33. A method of disassembling a process cartridge according to claim 26, wherein the material layer difficult to cut by said laser is ceramic film.

34. A method of disassembling a process cartridge according to claim 26, wherein the material layer difficult to cut by said laser is a ceramic sheet.

35. A method of disassembling a process cartridge according to claim 26, wherein said process cartridge has, in addition to said electrophotographic photosensitive member and said charging means, at least one of developing means for developing an electrostatic latent image formed on said electrophotographic photosensitive member by a developer, and cleaning means for removing the developer remaining on said electrophotographic photosensitive member.

36. A process cartridge detachably mountable to a main body of an electrophotographic image forming apparatus, said process cartridge comprising:

an electrophotographic photosensitive member;

charging means for charging said electrophotographic photosensitive member;

a material layer difficult to cut by a laser disposed in said charging means; and a cartridge frame holding said electrophotographic photosensitive member and said charging means, and being formed so that at least one part constituting said charging means is taken out by cutting said cartridge frame by use of said laser so as not to pass through the material layer difficult to cut by said laser.

37. A process cartridge according to claim 36, wherein the part constituting said charging means and taken out by cutting said process cartridge is a recyclable part.

38. A process cartridge according to claim 36, wherein the part constituting said charging means and taken out by cutting said process cartridge is a charging roller.

39. A process cartridge according to claim 36, wherein said cartridge frame comprises a material layer easy to cut by said laser, and is designed such that in cutting by the use of said laser, the material layer easy to cut by said laser is cut by said laser.

40. A process cartridge according to claim 36, wherein the material layer difficult to cut by said laser is disposed so that a recyclable part constituting said charging means may not be cut in cutting of said cartridge frame by the use of said laser.

41. A process cartridge according to claim 36, wherein the material layer difficult to cut by said laser is metal film.

42. A process cartridge according to claim 36, wherein the material layer difficult to cut by said laser is a metal sheet.

43. A process cartridge according to claim 36, wherein the material layer difficult to cut by said laser is ceramic film.

44. A process cartridge according to claim 36, wherein the material layer difficult to cut by said laser is a ceramic sheet.

45. A process cartridge according to claim 36, wherein said process cartridge comprises, in addition to said electrophotographic photosensitive member and said charging means, at least one of developing means for developing an electrostatic latent image formed on said electrophotographic photosensitive member by a developer, and cleaning means for removing the developer remaining on said electrophotographic photosensitive member.

46. An electrophotographic image forming apparatus for forming an image on a recording medium to a main body of which a process cartridge is detachably mountable, said electrophotographic image forming apparatus comprising:

(a) mounting means for detachably mounting said process cartridge, said process cartridge having:

an electrophotographic photosensitive member;

charging means for charging said electrophotographic photosensitive member;

a material layer difficult to cut by a laser disposed in said charging means; and a cartridge frame holding said electrophotographic photosensitive member and said charging means, and being formed so that at least one part constituting said charging means is taken out by cutting said cartridge frame by use of said laser so as not to pass through the material layer difficult to cut by said laser; and (b) conveying means for conveying said recording medium.

47. An electrophotographic image forming apparatus according to claim 46, wherein the part constituting said charging means and taken out by cutting said process cartridge is a recyclable part.

48. An electrophotographic image forming apparatus according to claim 46, wherein the part constituting said charging means and taken out by cutting said process cartridge is a charging roller.

49. An electrophotographic image forming apparatus according to claim 46, wherein said cartridge frame comprises a material layer easy to cut by said laser, and is designed such that in cutting by the use of said laser, the material layer easy to cut by said laser is cut by said laser.

50. An electrophotographic image forming apparatus according to claim 46, wherein the material layer difficult to cut by said laser is disposed so that a recyclable part constituting said charging means may not be cut in cutting of said cartridge frame by the use of said laser.

51. An electrophotographic image forming apparatus according to claim 46, wherein the material layer difficult to cut by said laser is metal film.

52. An electrophotographic image forming apparatus according to claim 46, wherein the material layer difficult to cut by said laser is a metal sheet.

53. An electrophotographic image forming apparatus according to claim 46, wherein the material layer difficult to cut by said laser is ceramic film.

54. An electrophotographic image forming apparatus according to claim 46, wherein the material layer difficult to cut by said laser is a ceramic sheet.

55. An electrophotographic image forming apparatus according to claim 46, wherein said process cartridge comprises, in addition to said electrophotographic photosensitive member and said charging means, at least one of developing means for developing an electrostatic latent image formed on said electrophotographic photosensitive member by a developer, and cleaning means for removing the developer remaining on said electrophotographic photosensitive member.

* * * * *

UNITED STATES PATENT AND TRADEMARK OFFICE

CERTIFICATE OF CORRECTION

PATENT NO. : 6,223,010 B1
DATED : April 24, 2001
INVENTOR(S) : Ryuji Araki

It is certified that error appears in the above-identified patent and that said Letters Patent is hereby corrected as shown below:

Column 2,
Line 21, "damaged.it" should read -- damaged. It --.
Line 57, "recycle," should read -- recycling, --.

Column 4,
Line 48, "injured." should read -- damaged. --.

Column 6,
Line 57, "Image" should read -- image --.

Column 9,
Line 66, "taken" should read -- take --.
Line 67, "this" should read -- these --.

Column 10,
Line 22, "to is" should read -- to --.

Column 11,
Line 2, "cut" should read -- being cut --.

Column 12,
Line 21, "Is" should read -- is --.
Line 33, "layer" should read -- layer that is --.
Line 52, "that is 15" should read -- 15 that is --.
Line 56, "that is 15" should read -- 15 that is --.

Column 13,
Line 29, "layers" should read -- layers that are --.

Column 14,
Line 29, "is cleaning" should read -- cleaning --.
Line 54, "layers" should read -- layers that are --.

Column 15,
Line 14, "cut" should read -- being cut --.
Line 34, "is" should be deleted.

Colum 17,
Line 18, "injured," should read -- damaged, --.
Line 23, "15" should read -- 15 that is --.

UNITED STATES PATENT AND TRADEMARK OFFICE

CERTIFICATE OF CORRECTION

PATENT NO. : 6,223,010 B1
DATED : April 24, 2001
INVENTOR(S) : Ryuji Araki

It is certified that error appears in the above-identified patent and that said Letters Patent is hereby corrected as shown below:

Column 19,
Line 53, "Intactly" should read -- intactly --.
Line 55, "injured." should read -- damaged. --.

Column 24,
Line 21, "not" should be deleted.

Colum 25,
Line 3, "not" should be deleted.

Signed and Sealed this

Twenty-second Day of January, 2002

*Attest:*

*Attesting Officer*

JAMES E. ROGAN
*Director of the United States Patent and Trademark Office*